US007374179B2

(12) United States Patent
Cole

(10) Patent No.: US 7,374,179 B2
(45) Date of Patent: May 20, 2008

(54) TRUCK ASSEMBLY FOR A SKATEBOARD, WHEELED PLATFORM, OR VEHICLE

(76) Inventor: Jeffrey E. Cole, 40 Gold Creek Ct., Danville, CA (US) 94506

( * ) Notice: Subject to any disclaimer, the term of this patent is extended or adjusted under 35 U.S.C. 154(b) by 147 days.

(21) Appl. No.: 11/315,804

(22) Filed: Dec. 21, 2005

(65) Prior Publication Data

US 2006/0125200 A1 Jun. 15, 2006

Related U.S. Application Data

(63) Continuation-in-part of application No. 11/051,088, filed on Feb. 4, 2005, now Pat. No. 7,232,139, which is a continuation-in-part of application No. 11/030,480, filed on Jan. 5, 2005, now Pat. No. 7,216,876, which is a continuation-in-part of application No. 10/874,134, filed on Jun. 21, 2004, now Pat. No. 7,040,638.

(51) Int. Cl.
*A63C 1/00* (2006.01)

(52) U.S. Cl. ..... 280/11.27; 280/11.28; 280/87.042

(58) Field of Classification Search ..... 280/11.28, 280/11.27, 11.19, 11.221, 11.223, 11.225, 280/11.233, 11.25, 87.042, 87.041, 842
See application file for complete search history.

(56) References Cited

U.S. PATENT DOCUMENTS 297,388 A 4/1884 Hall
527,082 A 10/1894 Smith
582,696 A 5/1897 Schneible et al.
590,492 A 9/1897 Calderwood et al.
787,988 A 4/1905 Moore
793,664 A 7/1905 Kleindienst et al.
865,117 A 9/1907 Muhl et al.
936,173 A 10/1909 Schoenberg
1,111,160 A 9/1914 Larsen et al.
1,208,173 A 12/1916 Lenhardt
1,364,471 A 1/1921 Ameli
1,410,326 A 3/1922 Labak
1,535,950 A 4/1925 Schramke
1,650,450 A 11/1927 Jochum
2,061,334 A 11/1936 Stone
2,177,381 A 10/1939 Bichi (Continued)

FOREIGN PATENT DOCUMENTS

DE 3829318 3/1990

(Continued)

OTHER PUBLICATIONS

2001 SilverThin Bearing Group of Mechatronics, Inc. Brochure.

*Primary Examiner*—Hau Phan
(74) *Attorney, Agent, or Firm*—Buchanan Ingersoll & Rooney LLP

(57) ABSTRACT

A truck assembly for a skateboard having an inner ring adapted to be attachable to a skateboard deck, and an outer ring adapted to be attachable to an axle extending from the outer ring, wherein the axle is configured to receive at least one wheel. The inner ring and the outer ring rotate relative to one another upon a change in an orientation of the skateboard deck.

16 Claims, 23 Drawing Sheets

U.S. PATENT DOCUMENTS

| | | | | |
|---|---|---|---|---|
| 2,195,812 | A | | 4/1940 | Czamecki |
| 2,434,546 | A | | 1/1948 | Breedlove |
| 2,589,449 | A | | 3/1952 | Stageberg |
| 2,699,649 | A | | 1/1955 | Messick |
| 2,852,183 | A | | 9/1958 | Breinig et al. |
| 2,976,698 | A | | 3/1961 | Muffly |
| 2,991,619 | A | | 7/1961 | Powell |
| 3,027,719 | A | | 4/1962 | Keech |
| 3,074,233 | A | | 1/1963 | Keech |
| 3,153,984 | A | | 10/1964 | Fikse |
| 3,216,363 | A | | 11/1965 | Snow et al. |
| 3,272,138 | A | | 9/1966 | Connoy et al. |
| 3,381,622 | A | | 5/1968 | Wilcox |
| 3,399,906 | A | | 9/1968 | Portnoff |
| 3,528,756 | A | | 9/1970 | Norlin et al. |
| 3,567,350 | A | | 3/1971 | Niemiec |
| 3,635,020 | A | | 1/1972 | Mahlmann |
| 3,642,388 | A | | 2/1972 | Maistrelli |
| 3,677,141 | A | | 7/1972 | Lagerqvist et al. |
| 3,822,965 | A | | 7/1974 | Drutchas et al. |
| 3,855,791 | A | | 12/1974 | Quinto |
| 3,866,935 | A | | 2/1975 | Nelson |
| 3,892,283 | A | | 7/1975 | Johnson |
| 3,971,215 | A | | 7/1976 | Baron et al. |
| 3,973,468 | A | | 8/1976 | Russell, Jr. |
| 4,040,310 | A | | 8/1977 | Giroux |
| 4,069,881 | A | | 1/1978 | Shiber |
| 4,087,105 | A | | 5/1978 | Amarantos |
| 4,109,466 | A | | 8/1978 | Keech |
| 4,111,618 | A | | 9/1978 | Thibault |
| 4,153,376 | A | | 5/1979 | Neier |
| 4,181,319 | A | | 1/1980 | Hirbod |
| 4,185,847 | A | | 1/1980 | Johnson |
| 4,196,916 | A | | 4/1980 | Schorr |
| 4,206,684 | A | | 6/1980 | Gosney et al. |
| 4,265,602 | A | | 5/1981 | Teruyama |
| 4,290,268 | A | | 9/1981 | Lowther |
| 4,319,760 | A | | 3/1982 | Romano |
| 4,347,047 | A | | 8/1982 | Shiozawa et al. |
| 4,355,542 | A | | 10/1982 | Tsutsumi et al. |
| 4,367,638 | A | | 1/1983 | Gray |
| 4,386,891 | A | | 6/1983 | Riefel et al. |
| 4,411,442 | A | | 10/1983 | Rills |
| 4,419,058 | A | | 12/1983 | Franklin, Jr. et al. |
| 4,451,055 | A | | 5/1984 | Lee |
| 4,459,807 | A | | 7/1984 | Koppen |
| 4,470,776 | A | | 9/1984 | Kostek et al. |
| 4,486,150 | A | | 12/1984 | Davis |
| 4,506,464 | A | | 3/1985 | Cartner |
| 4,541,791 | A | | 9/1985 | Ideta et al. |
| 4,546,990 | A | | 10/1985 | Harriger |
| 4,548,096 | A | | 10/1985 | Giocastro et al. |
| 4,582,342 | A | | 4/1986 | Lew et al. |
| 4,679,995 | A | | 7/1987 | Bristow |
| 4,688,815 | A | | 8/1987 | Smith |
| 4,712,633 | A | | 12/1987 | Suzuki et al. |
| 4,715,180 | A | | 12/1987 | Rosman |
| 4,738,456 | A | * | 4/1988 | Creason ..... 280/842 |
| 4,738,603 | A | | 4/1988 | Hattori |
| 4,807,896 | A | | 2/1989 | Philippi |
| 4,843,950 | A | | 7/1989 | Heyl |
| 4,861,054 | A | | 8/1989 | Spital |
| 4,886,298 | A | | 12/1989 | Shols |
| 4,915,403 | A | | 4/1990 | Wild et al. |
| 4,925,372 | A | | 5/1990 | Hansen |
| 4,934,251 | A | | 6/1990 | Barker |
| 4,934,253 | A | | 6/1990 | Berthold et al. |
| 4,955,626 | A | | 9/1990 | Smith et al. |
| 5,007,544 | A | | 4/1991 | Saotome et al. |
| 5,016,726 | A | | 5/1991 | Metcalf |
| 5,051,065 | A | | 9/1991 | Hansen |
| 5,147,183 | A | | 9/1992 | Gettel |
| 5,154,436 | A | | 10/1992 | Jez et al. |
| 5,169,166 | A | | 12/1992 | Brooks |
| 5,184,536 | A | | 2/1993 | Arai |
| 5,199,718 | A | | 4/1993 | Niemiec |
| 5,218,935 | A | | 6/1993 | Quinn, Jr. et al. |
| 5,224,719 | A | | 7/1993 | Goodspeed |
| 5,239,833 | A | | 8/1993 | Fineblum |
| 5,263,725 | A | | 11/1993 | Gesmer et al. |
| 5,266,018 | A | | 11/1993 | Niemiec |
| 5,280,935 | A | | 1/1994 | Sobocan |
| 5,285,742 | A | | 2/1994 | Anderson |
| 5,292,234 | A | | 3/1994 | Ling |
| 5,310,202 | A | | 5/1994 | Goodspeed |
| 5,310,326 | A | | 5/1994 | Gui et al. |
| 5,320,367 | A | | 6/1994 | Landis |
| 5,330,214 | A | | 7/1994 | Brooks et al. |
| 5,340,131 | A | | 8/1994 | Smathers et al. |
| 5,423,560 | A | | 6/1995 | Warrick et al. |
| 5,428,958 | A | | 7/1995 | Stenlund |
| 5,553,874 | A | | 9/1996 | Schouten et al. |
| 5,595,067 | A | | 1/1997 | Maness |
| RE35,493 | E | | 4/1997 | Horton |
| 5,642,991 | A | | 7/1997 | Singleterry et al. |
| 5,687,567 | A | | 11/1997 | Hansson et al. |
| 5,689,956 | A | | 11/1997 | Reboredo |
| 5,772,225 | A | | 6/1998 | Brackett |
| 5,778,671 | A | | 7/1998 | Bloomquist et al. |
| 5,794,955 | A | | 8/1998 | Flynn |
| 5,806,896 | A | | 9/1998 | Sato et al. |
| 5,811,037 | A | | 9/1998 | Ludwig |
| 5,826,674 | A | | 10/1998 | Taylor |
| 5,839,737 | A | | 11/1998 | Kruczek |
| 5,915,322 | A | | 6/1999 | Adams |
| 5,938,224 | A | | 8/1999 | Brackett |
| 5,947,495 | A | | 9/1999 | Null et al. |
| 5,950,754 | A | | 9/1999 | Ondrish, Jr. |
| 5,992,148 | A | | 11/1999 | Satake |
| 5,997,018 | A | | 12/1999 | Lee |
| 6,000,513 | A | | 12/1999 | Richards |
| 6,015,279 | A | | 1/2000 | Yamane |
| 6,022,201 | A | | 2/2000 | Kasmer et al. |
| 6,032,968 | A | | 3/2000 | Chattin |
| 6,035,976 | A | | 3/2000 | Duhamel |
| 6,050,357 | A | | 4/2000 | Staelin et al. |
| 6,050,796 | A | | 4/2000 | Waong et al. |
| 6,079,727 | A | | 6/2000 | Fan |
| 6,123,396 | A | | 9/2000 | Siegel |
| 6,131,933 | A | | 10/2000 | Fan |
| 6,149,409 | A | | 11/2000 | Palakodati et al. |
| 6,152,711 | A | | 11/2000 | Van Wijk et al. |
| 6,158,752 | A | | 12/2000 | Kay |
| 6,173,981 | B1 | | 1/2001 | Coleman |
| 6,182,779 | B1 | | 2/2001 | Hosoda |
| 6,217,398 | B1 | | 4/2001 | Davis |
| 6,241,264 | B1 | | 6/2001 | Page |
| 6,315,313 | B1 | | 11/2001 | Huang |
| 6,371,501 | B2 | | 4/2002 | Jenkins |
| 6,419,248 | B1 | | 7/2002 | Kay |
| 6,422,845 | B1 | | 7/2002 | Wong et al. |
| 6,425,313 | B1 | | 7/2002 | Kleinedler et al. |
| 6,425,450 | B1 | | 7/2002 | Lansberry |
| 6,443,471 | B1 | | 9/2002 | Mullen |
| 6,450,448 | B1 | | 9/2002 | Suzuki |
| 6,467,560 | B1 | | 10/2002 | Anderson |
| 6,488,296 | B2 | | 12/2002 | Ireton |
| 6,499,964 | B2 | | 12/2002 | Staton et al. |
| 6,523,837 | B2 | * | 2/2003 | Kirkland ..... 280/11.28 |
| 6,536,788 | B1 | | 3/2003 | Kuncz et al. |
| 6,537,047 | B2 | | 3/2003 | Walker |
| 6,571,757 | B1 | | 6/2003 | Simpson |
| 6,592,486 | B1 | | 7/2003 | Arbanas et al. |
| 6,612,117 | B2 | | 9/2003 | Kasmer |

| | | | |
|---|---|---|---|
| 6,626,442 | B2 | 9/2003 | Pahis |
| 6,629,829 | B1 | 10/2003 | Shinoda et al. |
| 6,647,719 | B2 | 11/2003 | Truninger |
| 6,655,936 | B2 | 12/2003 | Szeszulski et al. |
| 6,659,480 | B1 | 12/2003 | Newman |
| 6,663,362 | B1 | 12/2003 | Lentz et al. |
| 6,669,215 | B2 | 12/2003 | Laporte |
| 6,685,201 | B1 | 2/2004 | Smith, III |
| 6,688,624 | B2 | 2/2004 | Christensen et al. |
| 6,688,862 | B2 | 2/2004 | Jeronymo et al. |
| 6,698,196 | B2 | 3/2004 | Hashimoto et al. |
| 6,848,527 | B2 | 2/2005 | Nelson |
| 6,913,272 | B2 | 7/2005 | Chang |
| 2005/0012290 | A1 | 1/2005 | McClain |
| 2005/0127629 | A1 | 6/2005 | Nelson et al. |
| 2006/0119062 | A1 | 6/2006 | Lukoszek |

FOREIGN PATENT DOCUMENTS

| | | |
|---|---|---|
| DE | 3942210 | 6/1991 |
| EP | 558776 | 9/1993 |
| FR | 2702012 | 9/1994 |

* cited by examiner

TRUCK ASSEMBLY FOR A SKATEBOARD, WHEELED PLATFORM, OR VEHICLE

CROSS-REFERENCE TO RELATED APPLICATIONS

This application is a Continuation-in-part of U.S. patent application Ser. No. 11/051,088, filed Feb. 4, 2005 now U.S. Pat. No. 7,232,139, which is a Continuation-in Part of U.S. patent application Ser. No. 11/030,480, filed Jan. 5, 2005 now U.S. Pat. No. 7,216,876, which is a Continuation-in-Part of U.S. patent application Ser. No. 10/874,134, filed Jun. 21, 2004 now U.S. Pat. No. 7,040,638, which are incorporated herein in their entirety.

FIELD OF THE INVENTION

This invention generally relates to a truck assembly for a skateboard, a wheeled platform or a vehicle and more particularly to the assembly for a mechanized truck that converts differential movement of the platform(s) relative to the truck into rotational energy used to help propel the wheeled platform, vehicle, or skateboard or into sensory information used to control the braking, steering and locomotion of the wheeled platform, vehicle, or skateboard.

BACKGROUND OF INVENTION

The truck is an important element in the design of skateboards, wheeled platforms, roller skates, inline skates and vehicles. The truck not only supports the wheels of the skateboard, platform, inline skates, roller skates or vehicle, it may also provide the user with a significant degree of directional control.

In a typical skateboard truck, directional control is accomplished by providing the truck with four primary components: a truck hanger, a base plate, a kingpin, and bushings. Typically skateboard trucks (FIGS. 1 and 2) have two (2) axle extensions, which protrude laterally from the sides of the truck hanger upon which the skateboard wheels and bearings are mounted. Skateboard trucks are a wide variety of construction and designs beyond the typical truck described herein. Each of these trucks designs tends to exhibit most, if not all, of the characteristics described below. Skateboard trucks are typically mounted to the skateboard deck in a front (or leading) and rear (or trailing) position along the longitudinal or lengthwise axis of the skateboard deck such that, at rest, the truck axle extensions at the leading position are roughly parallel to the truck axle extensions at the trailing position and all truck axle extensions are roughly perpendicular to the longitudinal axis of the skateboard deck when the skateboard is at rest. If this approximately parallel alignment of the trucks and their respective axles are maintained while the skateboard rolls along the ground, the skateboard's path will be relatively straight.

A skateboard truck typically exhibits some dynamic response when the user of the skateboard or wheeled platform leans to one side or the other. Such dynamic response tends to cause the truck hanger and axles to exhibit a component of rotation, in part, around a vertical axis, or an axis oriented perpendicular to the ground surface upon which the skateboard is positioned. The leading hanger and trailing hanger typically (but not necessarily) rotate in opposite directions. Thus, the user can turn, or otherwise control the forward direction of the wheeled platform, by shifting his or her body from one side of the platform to the other. Bushings are located between the truck base plate and truck hanger in the most common truck design. A kingpin connects the hanger, base plate and bushings together. The threaded kingpin can be tightened and loosened to modify rigidity of the bushings, and the dynamic response characteristics of the truck. Loose or slack bushings generally allow greater movement of the hanger about the kingpin and vertical axis of the truck, and thus are less responsive to slight weight shifts than are tight or rigid bushings.

Most, if not all skateboard truck designs exhibit some undesirable ride characteristics. One such undesired ride characteristic is instability or "speed wobble", which occurs when the axle and hanger develop a resonant frequency of vibration and uncontrolled wobbling within their typical range of motion. This can cause instability in the user's control of the skateboard, wheeled platform or vehicle. Speed wobbles occur on most skateboard truck designs. Different designs experience these wobbles at different speeds and under different conditions.

Most of the common skateboard truck designs do not transfer energy generated by the rider into the rotation of the skateboard wheels, resulting directly in the locomotion of a skateboard, wheeled platform or vehicle. Accordingly, what is needed is an improved truck assembly that can dynamically steer a wheeled platform, substantially reduce the impact of speed wobbles under typical riding conditions, and generate rotational energy to be used to propel the skateboard, wheeled platform, roller skates, inline skates, or vehicle.

Additionally, for maximum transfer of energy from the rider to the rotation of the at least one rotor, axle or wheel, the rider's gravitational, centrifugal and muscular energy should be structurally supported predominantly or entirely by components actively involved in the transfer of energy from the platform to the wheels. Accordingly, what is additionally needed is an entirely new truck design that strives to minimize support structures that are not used directly in the transfer of energy from the rider into the wheels.

SUMMARY OF THE INVENTION

In one aspect of the invention, a truck assembly for a skateboard comprises: an inner ring adapted to be attachable to a skateboard deck; and an outer ring adapted to be attachable to an axle extending from the outer ring, wherein the axle is configured to receive at least one wheel, and wherein the inner ring and the outer ring rotate relative to one another upon a change in an orientation of the skateboard deck.

In another aspect of the invention, a truck assembly for a skateboard comprises: a plurality of wheeled roller bearings adapted to be attachable to a skateboard deck; and an outer ring adapted to be attachable to an axle extending from the outer ring, wherein the axle is configured to receive at least one wheel, and wherein the plurality of wheeled roller bearings and the outer ring rotate relative to one another upon a change in an orientation of the skateboard deck.

In a further aspect of the invention, a skateboard comprises: a skateboard deck; a pair of truck assemblies comprising: an inner ring adapted to be attachable to a skateboard deck; and an outer ring adapted to be attachable to an axle extending from the outer ring, wherein the axle is configured to receive at least one wheel, and wherein the inner ring and the outer ring rotate relative to one another upon a change in an orientation of the skateboard deck, an axle extending from the outer ring and configured to receive a wheel; and a plurality of wheels attached to the axles extending from the outer ring.

In a further aspect of the invention, a skateboard comprises: a skateboard deck; a pair of truck assemblies comprising: plurality of wheeled roller bearings adapted to be attachable to a skateboard deck; and an outer ring adapted to be attachable to an axle extending from the outer ring, wherein the axle is configured to receive at least one wheel, and wherein the plurality of wheeled roller bearings and the outer ring rotate relative to one another upon a change in an orientation of the skateboard deck, an axle extending from the outer ring and configured to receive a wheel; and a plurality of wheels attached to the axles extending from the outer ring.

BRIEF DESCRIPTION OF THE DRAWINGS

The invention will now be described in greater detail with reference to the preferred embodiments illustrated in the accompanying drawings, in which like elements bear like reference numerals, and wherein.

DESCRIPTION OF THE INVENTION

Figure 1:
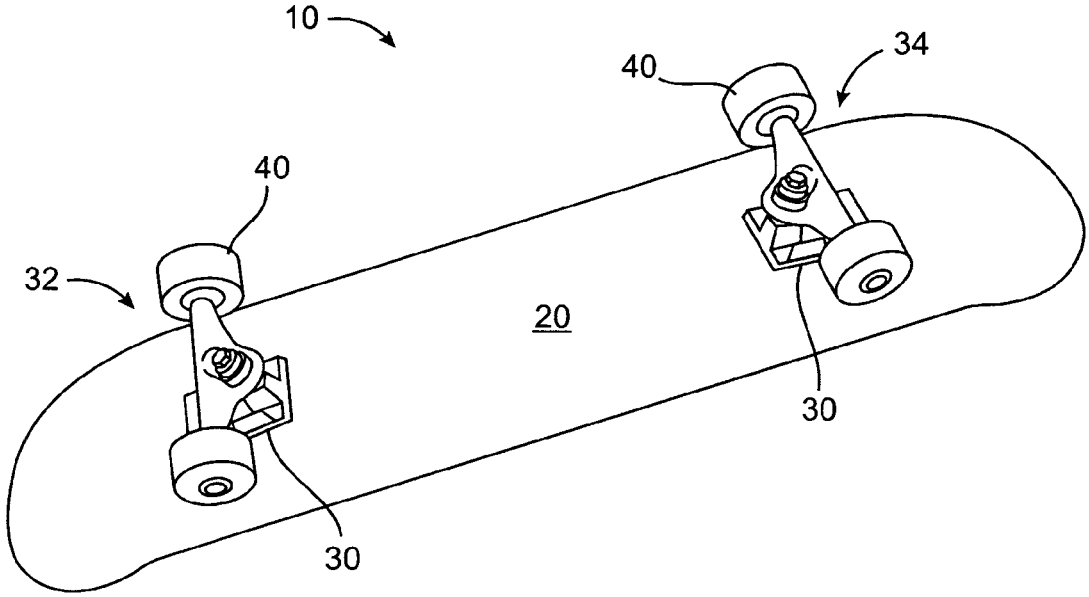
FIG. 1 (Prior Art)
FIG. 1 shows a perspective view of a skateboard.

As shown in FIG. 1, a skateboard 10 typically comprises a deck 20, a pair of skateboard trucks 30, and a plurality of wheels 40, most commonly four (4) wheels. Existing skateboard products have anywhere from 2 to 14 or more wheels. Skateboard trucks 30 made by various manufacturers vary significantly in design, but the most common designs (FIG. 2) typically have two (2) axle extensions 66, which protrude laterally from the sides of the truck 30 upon which the skateboard wheels 40 and bearings are mounted. Skateboard truck assemblies 30 are typically mounted to the skateboard deck 20 in a front 32 (or leading) and rear 34 (or trailing) position along the longitudinal or lengthwise axis of the skateboard deck 20 such that, at rest, the truck axle extensions 66 at the leading position 32 are roughly parallel to the truck axle extensions 66 at the trailing position 34 and all truck axle extensions 66 are roughly perpendicular to the longitudinal axis of the skateboard deck 20 when the skateboard 10 is at rest. If this approximately parallel alignment of the truck assembly 30 and their respective axles are maintained while the skateboard 10 rolls along the ground, the skateboard's path will be relatively straight.

The skateboard deck 20 most commonly comprises a single piece of fiberglass, wood, wood laminates or wood composite or any suitable material for the skateboard deck 20. In addition, the deck 20 can have variable degrees of stiffness and flexibility based on the weight of the rider and the riders skateboarding style, i.e. gradual turns or a more aggressive pumping action of the skateboard deck 20. Some skateboard decks 20 consist of multiple pieces and/or are made from a combination of different materials.

The skateboard truck 30 most commonly comprises a multiple pieces of aluminum, steel, and/or other metals, and elastic components. Skateboard truck components can be constructed with any suitable material, including but not limited to fluids, gasses, plastics, rubber, metal, fabric, wood, electronics, etc.

Figure 2:
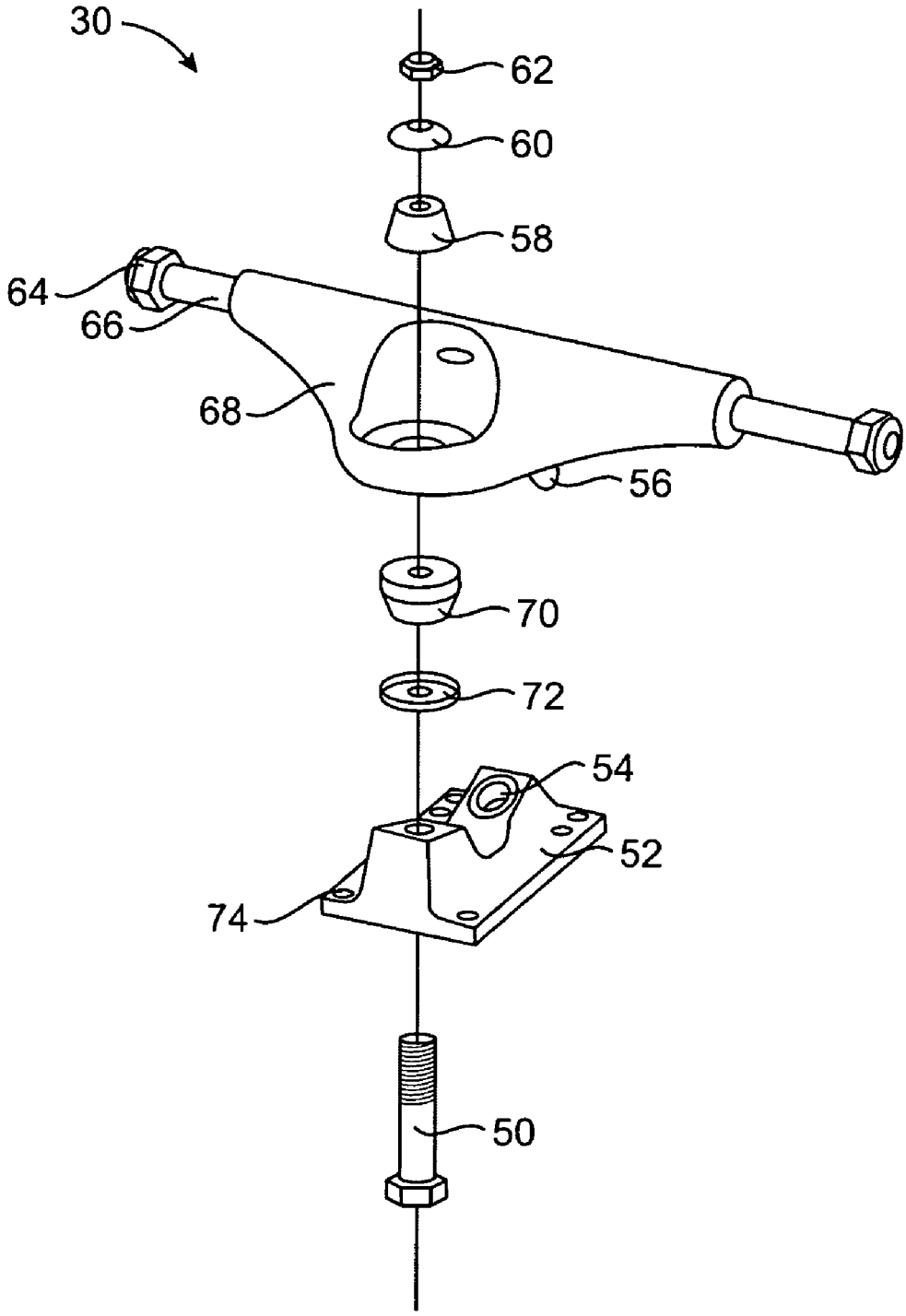
FIG. 2 (Prior Art)
FIG. 2 shows an exploded perspective view of a skateboard truck.

FIG. 2 shows an exploded perspective view of a common style of skateboard truck 30. However, it can be appreciated that the embodiments described herein can be implemented with any skateboard truck 30 and skateboard truck design.

As shown in FIG. 2, a common skateboard truck 30 comprises a kingpin 50, a base plate 52, a pivot cup 54, a pivot 56, an upper cushion (aka bushing) 58, an upper cushion washer 60, a kingnut 62, a pair of axle nuts 64, a hanger 68, axle extensions 66 which protrudes from two ends of the hanger 68, a bottom cushion (aka bushing) 70 and a bottom cushion washer 72.

The base plate 52 has a plurality of openings 74. The openings 74 are configured to each receive bolts (not shown) for attaching the base plate 52 of the truck 30 to the deck 20 of the skateboard 10. Each of the two axle extensions 66 can receive a wheel 40. The wheel 40 preferably includes bearings (not shown), and washers or spacers (not shown), which properly position the bearings and wheels 40 such that they can freely spin without rubbing against the hanger 68. The wheel 40 is secured to the axle extension 66 with an axle nut 64.

The plurality of wheels 40, are preferably skateboard wheels or suitable wheels preferably having bearings, which can be attached to the wheels and which fit over the axle extension 66 of the skateboard truck 30. The at least one axle extension 66 preferably protrudes from hanger 68 and is configured to receive a wheel 40. It can be appreciated that the skateboard 10 can be equipped with a hydraulic truck as shown in U.S. patent application Ser. No. 10/874,134, filed Jun. 21, 2004, which is incorporated herein in its entirety, in the front or rear of the skateboard and one standard truck at the opposite end of the skateboard. Alternatively, multiple hydraulic trucks can be mounted on the skateboard 10.

Figure 3:
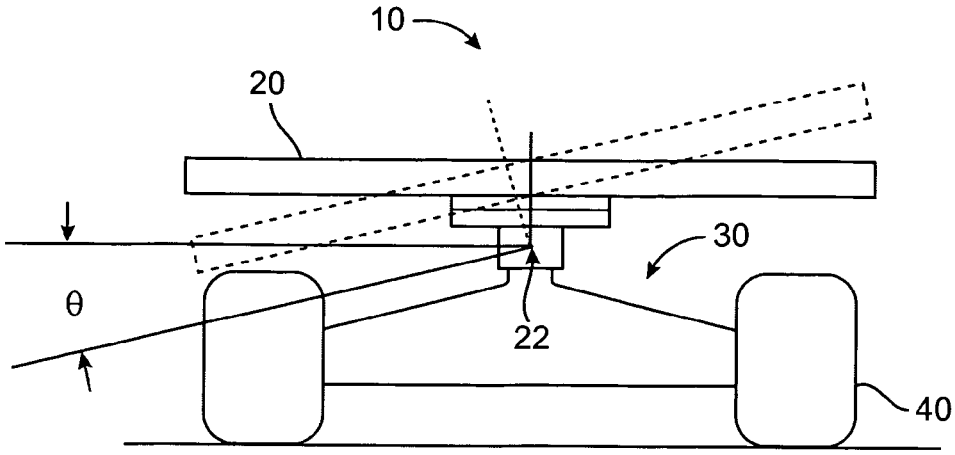
FIG. 3 (Prior Art)
FIG. 3 shows an end view of a skateboard.

FIG. 3 shows an end view of a skateboard 10. As shown in FIG. 3, the weight of the skateboarder upon shifting his or her weight from side to side of the skateboard 10 causes the deck 20 of the skateboard to rotate about a pivot point 22, which is typically below the plane of the deck 20 of the skateboard 10. The pivot point 22 is typically located in the vicinity of the bushings 58, 70 of a common truck (FIG. 2). The pivot points 22 for a leading truck and a trailing truck are preferably each located on a plane which is perpendicular to the skateboard deck 20, and which also passes through the longitudinal axis of the skateboard deck 20. The axis of rotation of the skateboard deck 20 is defined by an imaginary line, which connects the two pivot points 22 on the leading and trailing trucks 30. It can be appreciated that the axis of rotation may not be so positioned without deviating from this invention. It can be appreciated that the position of the axis of rotation may dynamically shift in response to changes in orientation of the skateboard 10 without deviating from this invention.

Figure 4:
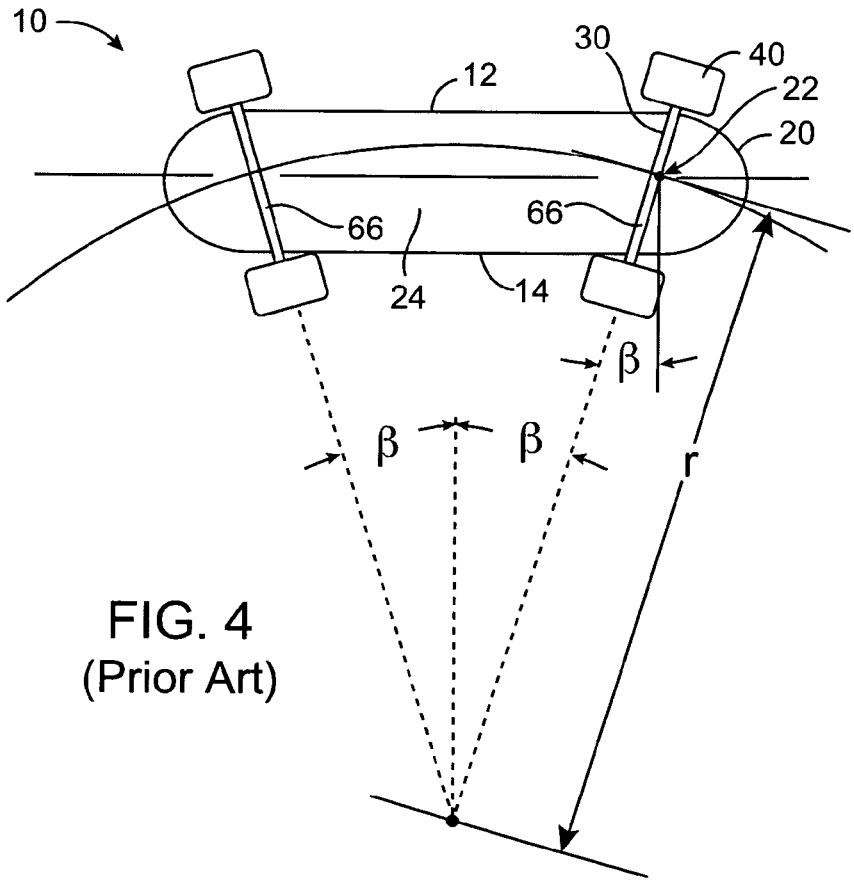
FIG. 4 (Prior Art)
FIG. 4 shows a plan view of a skateboard.

FIG. 4 shows a bottom view of the skateboard 10 showing the skateboard's turning radius. As shown in FIG. 4, the turning path of the skateboard 10 will curve in the direction of the edge 14 of the skateboard that has been forced downwards. The greater the deck dipping angle, theta (θ), as seen in FIG. 3, of the skateboard deck 20 measured from its resting position and around the longitudinal axis connecting points 22, the greater the trucks' 30 turning angles, beta (β), from their resting parallel position, measured around a vertical axis passing through pivot points 22, and the shorter the turning radius, r, of the skateboard's path. When one edge 14 of the skateboard deck 20 is rotated downward by the deck dipping angle theta (θ), around the longitudinal axis connecting pivot points 22, the ends of the axle extensions 66 on that side of the skateboard 10 are caused to mechanically move towards one another, thus achieving the potential for the skateboard 10 to have a curved path.

As shown in FIG. 4, the skateboards path becomes curved when the axles 66 of the two trucks 30 are caused to have an alignment, which is no longer parallel to one another and no longer perpendicular to the longitudinal axis of the skateboard deck 20. The variable turning angle, beta (β), that the axle extension 66 of a truck 30 makes relative to its resting position (perpendicular to the longitudinal axis of the skateboard deck), is typically similar in magnitude, but opposite in direction, for each of the two trucks 30. It can be appreciated that the beta angle for the front and rear trucks 30 may be designed to be different from one another and/or in the same or opposite directions for a given dip angle, theta (θ), of the deck 20 without deviating from this invention.

The truck axle extensions 66 positions and alignment are designed to respond variably to different changes in the deck dipping angle, theta (θ), of the skateboard deck 20 from a first position to a second position. The path of the skateboard 10 will curve in the direction of the edge 14 of the skateboard deck 20 that has been forced downwards. The greater the deck dipping angle, theta (θ), of the skateboard deck 20, the greater the trucks' 30 turning angle, beta (β), from their resting position and the shorter the radius of curvature, r, of the skateboards 10 path.

Trucks 30 have various mechanical designs. Trucks 30 are designed by different manufacturers to have different and varying mechanical and/or turning angle beta (β), responses to the deck-dipping angle, theta (θ) of the skateboard deck 20 upon which, the trucks 30 are mounted. Some trucks 30 have no moving parts and rely on the geometry of the truck axle to facilitate the skateboard's 10 variable turning radius when the deck 20 is variably rotated from its resting position. Some trucks have single wheels (1), some have two (2) wheels, some trucks have three (3) wheels, and some others have seven (7) wheels. Mechanically, these trucks 30 appear and operate differently from one another but share a similar goal: a dynamic steering system which responds to the dipping of the skateboard deck 20 around the axis parallel to the longitudinal axis of the deck 20. Most of the truck designs, which include moving parts, also include a central or axial support structure such that the weight of the rider is carried through a single axial position. Speed wobbles detract from the riding experience for many of these truck designs due to a repetitive vibration of the truck assembly around the single structural pivot point. These speed wobbles may become so severe that they cause the rider to lose control of the skateboard. Moving the support structure away from the central axis will provide greater control of the skateboard and reduce or eliminate speed wobbles within the nominal riding speeds for the skateboard. Most, if not all, of the truck designs do not integrate a means of converting the lateral dipping of the skateboard deck directly or indirectly into locomotion of the skateboard. Most, if not all of the truck designs do not include a support structure, which enables the transfer of the entire load pressing on the deck via the rider's weight, gravity, muscular power, or centrifugal force into the components designed for locomotion of the skateboard. Most, if not all, truck designs do not include sensors which detect the relative motion of the skateboard deck with respect to the truck assembly and use that sensory information to control the distribution of supplementary energy sources to operate other functions on the platform, such as the locomotion, auditory, or visual effects of the board through the release of supplementary energy sources.

It is typical, but not universal, that the magnitude of the turning response, beta (β), of both of the skateboard trucks 30 on the skateboard 10 will be similar to each other but opposite in direction such that an imaginary linear extension of each trucks axle extensions 66 will cross and define a radius of curvature of the skateboard's 10 path. Some skateboard designs include one truck that does not ever change its orientation with respect to the deck and instead relies entirely on the other truck's response to the dipping deck 20 to enable the skateboard 10 to be steered by the rider. The greater the deck dipping angle, theta (θ), of the skateboard deck 20, the greater the turning angle, beta (β), of each typical truck 30, and the smaller the turning radius, (r), of the skateboard's 10 path. Some skateboard 10 designs have a designated front (or leading) truck 30 and rear (or trailing) truck 30. The rear truck's 30 response may be more responsive to decking dipping angle, theta (θ), thereby providing a fishtailing motion, which is not optional at increased deck dipping angles, theta (θ).

Figure 5:
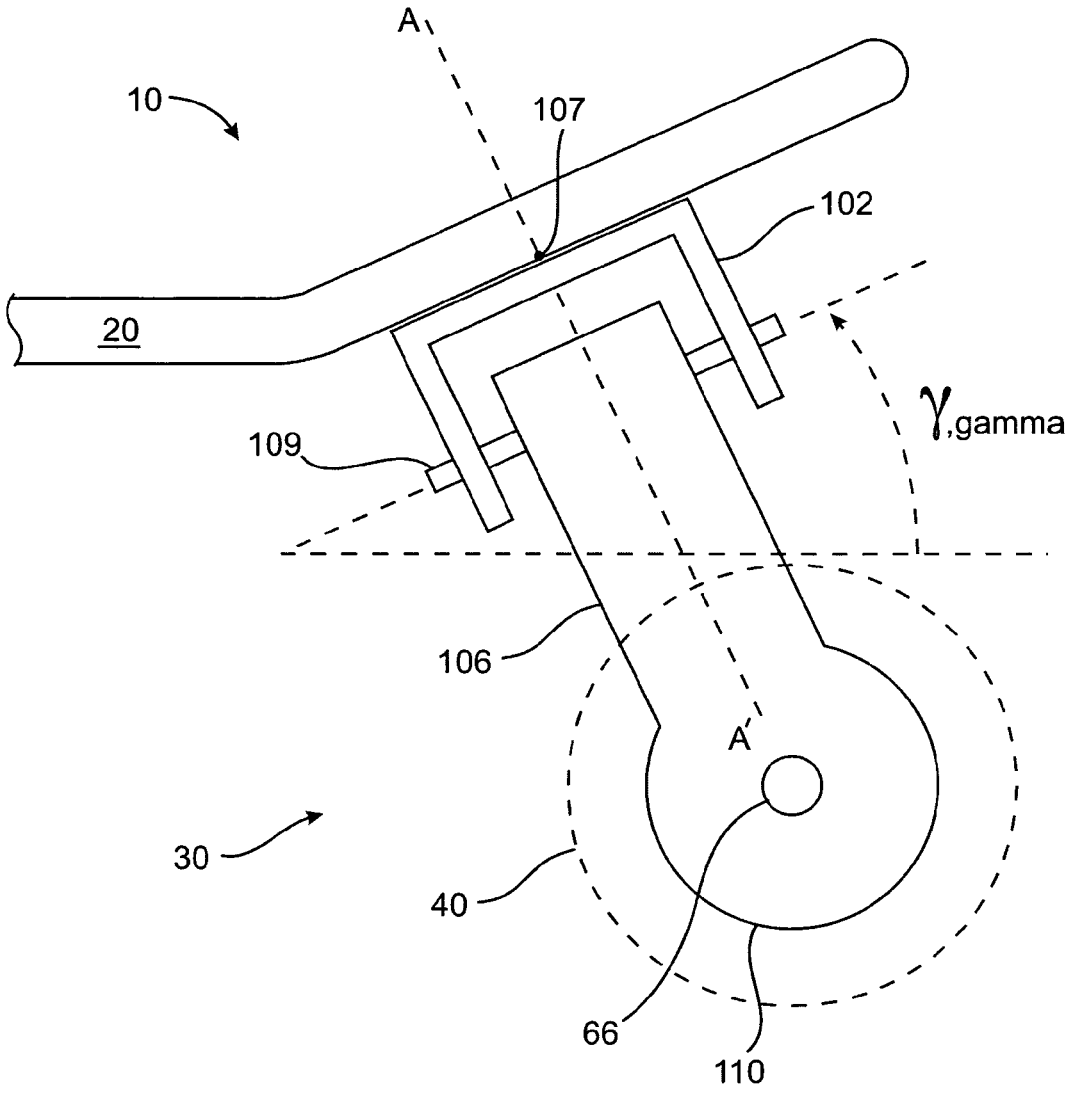
FIG. 5 (Prior Art)
FIG. 5 shows a side view of one end of a skateboard with an alternate truck assembly.

FIG. 5 shows a side view of one end of a skateboard 10 having an alternate truck assembly 30 comprising an inclined axial pivot point 109. The truck assembly 30 comprises a base plate bracket 102, a pivot member 106, an axle housing 110, and an axial pivot pin 109. It can be appreciated that truck assembly 30 designs based on this configuration can include other parts, including but not limited to fasters, washers, springs, and other suitable parts.

As shown in FIG. 5, the base plate bracket 102 can be configured to be attachable to the underside of the skateboard deck 20 with fasteners (not shown). The axle housing 110 includes a supporting structure or pivot member 106, which slips into and rotates within the base plate bracket 102. An axial pivot pin 109 connects the base plate bracket 102 to the pivot member 106 and allows the axle housing 110 to rotate around the axis of the axial pivot pin 109 as the rider dips the skateboard deck 20 from side to side. It can be appreciated that the axial pivot pin 109 can be fastened with washers, nuts, and other suitable components (not shown) to the base plate bracket 102.

The axial pivot pin 109 in FIG. 5 is configured to be inclined at an axial pin angle, gamma (γ), relative to the ground surface upon which the skateboard 10 is positioned. It is this angle, gamma (γ), which dictates the turning response angle, beta (β, as shown in FIG. 4), in response to the deck-dipping angle theta (θ, as shown in FIG. 5). The greater the axial pin angle, gamma (γ), the greater the turning response angle, beta (β), to any given deck dipping angle, theta (θ). If the axial pin angle, gamma (γ), is zero (0), then the turning response angle, beta (β), will be zero (0) in response to any given deck dipping angle, theta (θ). The axial pin angle, gamma (γ), may be positive or negative, thus creating the opportunity for unusual responses to the deck dipping angle, theta (θ).

Additionally, as shown in FIG. 5, the axial pin angle, gamma (γ), can be adapted to be adjustable (statically, or dynamically) to alter the turning characteristics of the skateboard 10. Because the skateboard wheels 40 tend to stay in contact with the riding surface due to the gravitational load of the rider, the axle housing 110 and attached structural pivot member 106 rotate around the axial pivot pin 109 in response to the rider dipping the deck 20 from left to right, theta (θ). Thus, when the rider dips the deck 20 left or right, theta (θ), the skateboard 10 has a turning response, beta (β), whose magnitude is defined by the axial pin angle, gamma (γ).

Figure 6:
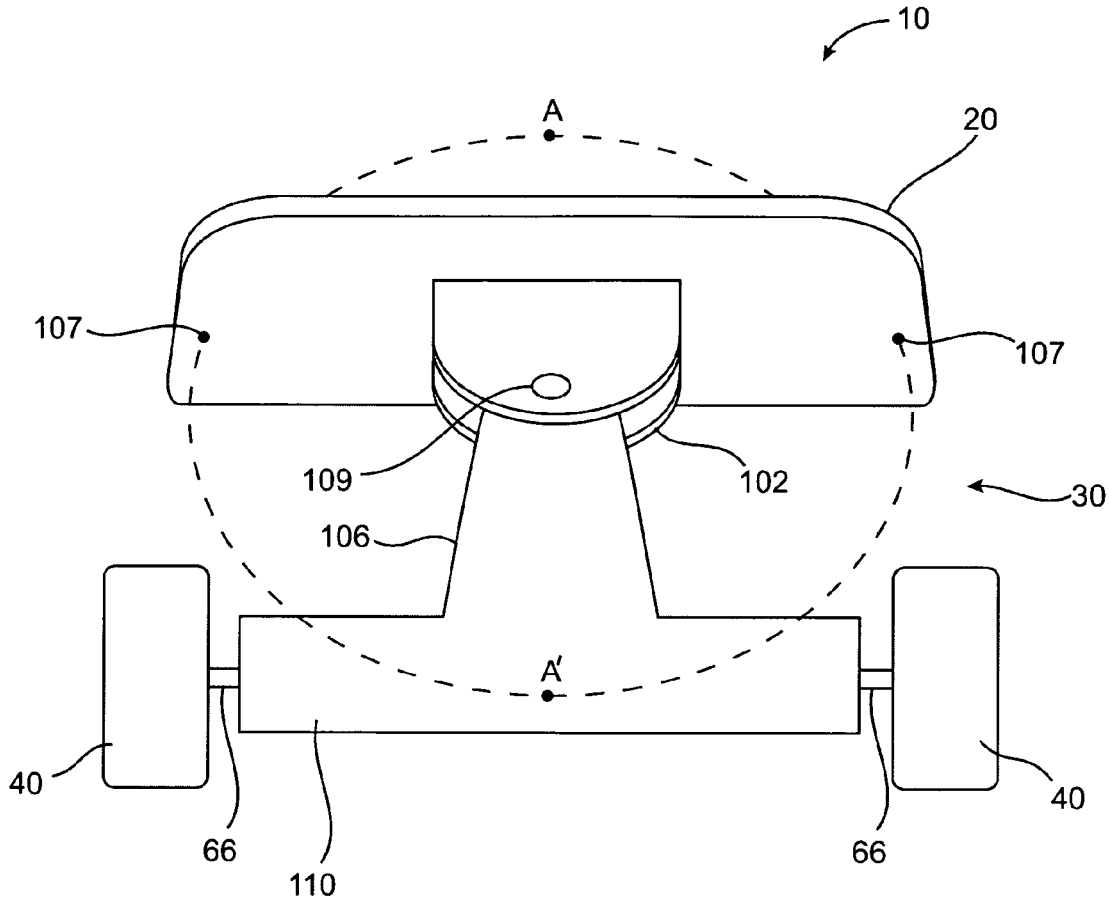
FIG. 6 (Prior Art)
FIG. 6 shows an end view of a skateboard with the alternate truck assembly of FIG. 5.

FIG. 6 shows an end view of the skateboard 10 and truck 30 of FIG. 5. As shown in FIG. 6, as the truck 30 rotates around the axial pivot point 109, a reference point A' on the pivot member 106 moves in a concentric circle around the pivot point 109. The plane of the concentric circle of reference point A' is perpendicular to the axis of the axial pivot pin 109 and therefore appears as an ellipse when drawn on the plane of the FIG. 6. The concentric circle maintains its axial alignment with that of the axial pivot pin 109 as the deck 10 is dipped left or right by any deck dipping angle, theta (θ), such that the plane formed by the concentric circle maintains the same angle, gamma (γ), when measured relative to the perpendicular to the ground surface. The concentric circle passes through a pair of intersection points 107 on the skateboard deck 20. As the skateboard deck 20 dips left and right through its deck dipping angle theta (θ, as shown in FIG. 3), the pivot member 106 and the truck housing 110 rotate in a concentric path around the axial pivot pin 109. The position of the concentric circle relative to the axial pivot pin 109 remains fixed and the position of the intersection points 107 remain fixed to the same spot on the skateboard deck 20.

It can be appreciated that in an alternative embodiment for a skateboard truck assembly 30, the structural axial pivot pin 109, the pivot member 106, and the base plate bracket 102 can be replaced with a more widely spaced structural design, which utilizes variations of the geometry and static position of the concentric circle in FIG. 6. This more widely spaced structural design increases stability, reduces speed wobbles, provides a greater range of turning characteristics, reduces the minimum number of parts, and provides a means of transferring energy from the rider to the wheels through the structural truck assembly components.

Figure 7A:
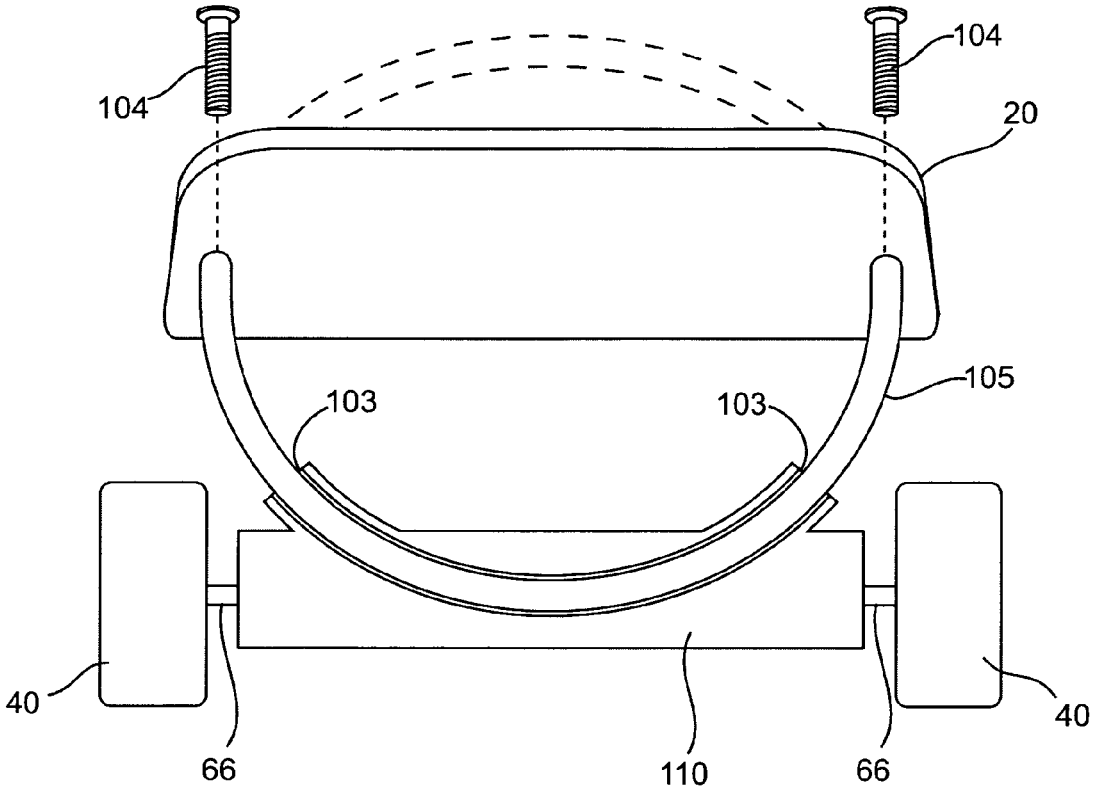
FIG. 7A shows an end view of a skateboard having an alternate truck assembly.

FIG. 7A shows a cross sectional view of an alternative embodiment of a skateboard truck assembly 30 attached to a skateboard deck 20. The truck assembly 30 includes a platform element 105 and an axle housing 110. The axle housing 110 includes openings 103 configured to movably receive the platform element 105. The axle housing 110 also has one or more axle extensions 66. Each axle extension 66 may receive one or more wheels 40. In this embodiment the platform member 105 is configured in a shape similar to that of the concentric circle in FIG. 6. The plane, which contains this concentric circle, is inclined at an angle, gamma (γ), measured from a perpendicular drawn from the ground surface, as shown in FIG. 6.

The platform element 105 is attached to the skateboard deck 20 preferably by bolts or screws 104, which are strong enough to allow the structural stability required to maintain the position of the platform element 105 relative to the skateboard deck 10. The platform element 105 may be attached to the deck 20 with pins, flexible fasteners, pivoting fasteners, welding, or any other suitable means of flexibly, rotationally, or fixedly attachment without deviating from this invention.

In this embodiment the platform element 105 slides through the curved openings 103 in the axle housing 110, changing the contact point between the platform element 105 and axle housing 110. The change in the contact point between the platform element 105 relative to the axle housing 110 results in a turning response of the skateboard deck 20 or wheeled platform. The curved openings 103 have a shape, which closely matches that of the platform element 105. In this embodiment some sort of lubrication or suitable material can be used to allow easier movement between the two parts. The turning response angle, beta (β in FIG. 4) for the embodiment of FIG. 7A should be the same as that turning response for the embodiment in FIG. 6 so long as the orientation of the concentric circle in FIG. 6 is the same as the orientation of the platform element 105 in FIG. 7A. It can be appreciated that the structural elements (the base plate bracket 102, the pivot member 106 and the axial pivot pin 109) in FIG. 6 can be added to the embodiment in FIG. 7A for additional structural stability without deviating from this invention.

It can be appreciated that the truck assembly 30 can additionally be equipped with a pair of springs (not shown). The pair of springs assists with returning the axle housing 110 to a centered position. The pair of springs is preferably positioned around the exposed platform element 105. However, it can be appreciated that the pair of springs can be enclosed or encased for performance and safety purposes. It can be appreciated that any suitable material or element can be positioned around the platform element 105 to assist with returning the axle housing 110 to a centered position.

Figure 7B:
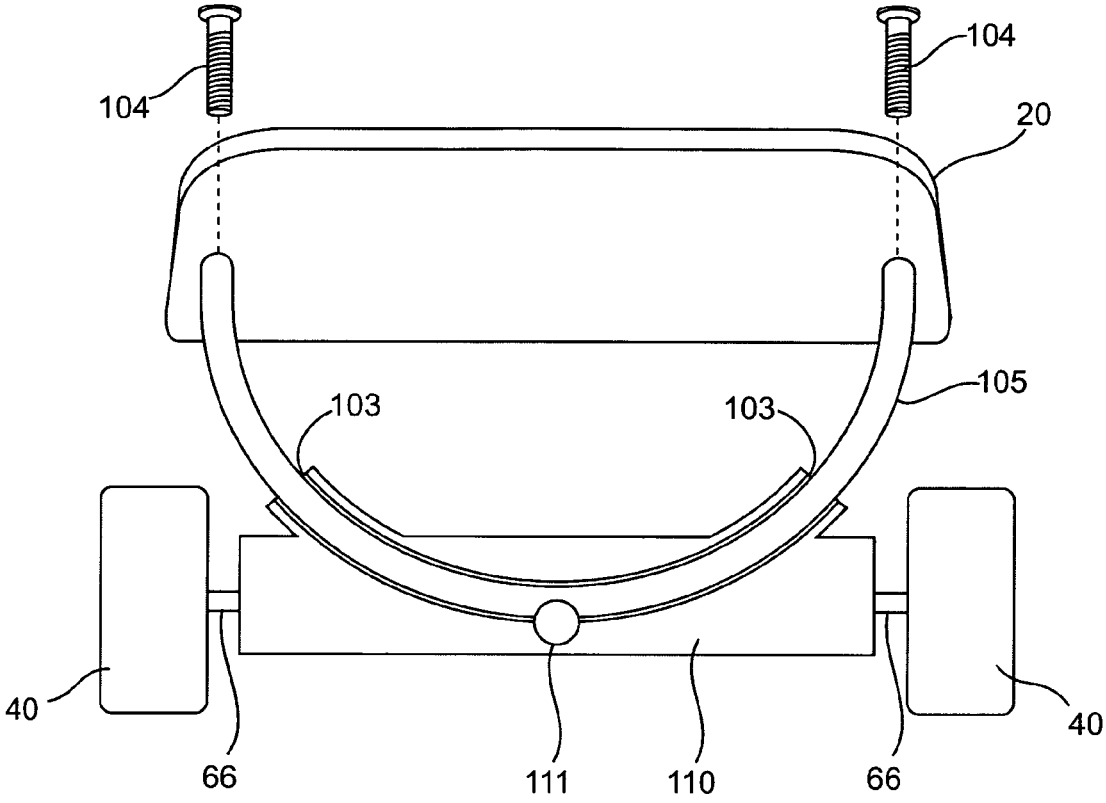
FIG. 7B shows an end view of a skateboard having an alternate truck assembly.

FIG. 7B shows an alternative embodiment of the truck assembly 30 as shown in FIG. 7A. As shown in FIG. 7B, the truck assembly 30 comprises the platform element 105, and axle housing 110 as shown in FIG. 7A and further comprising one or more roller bearings 111. The one or more roller bearings 111 are configured to ease or guide the movement, and/or reduce the friction between the platform element 105 and axle housing 110. It can be appreciated that additional bearings, rollers and guides can be added to improve the control and motion of the platform element 105 relative to the axle housing 110 without deviating from this invention.

Figure 7C:
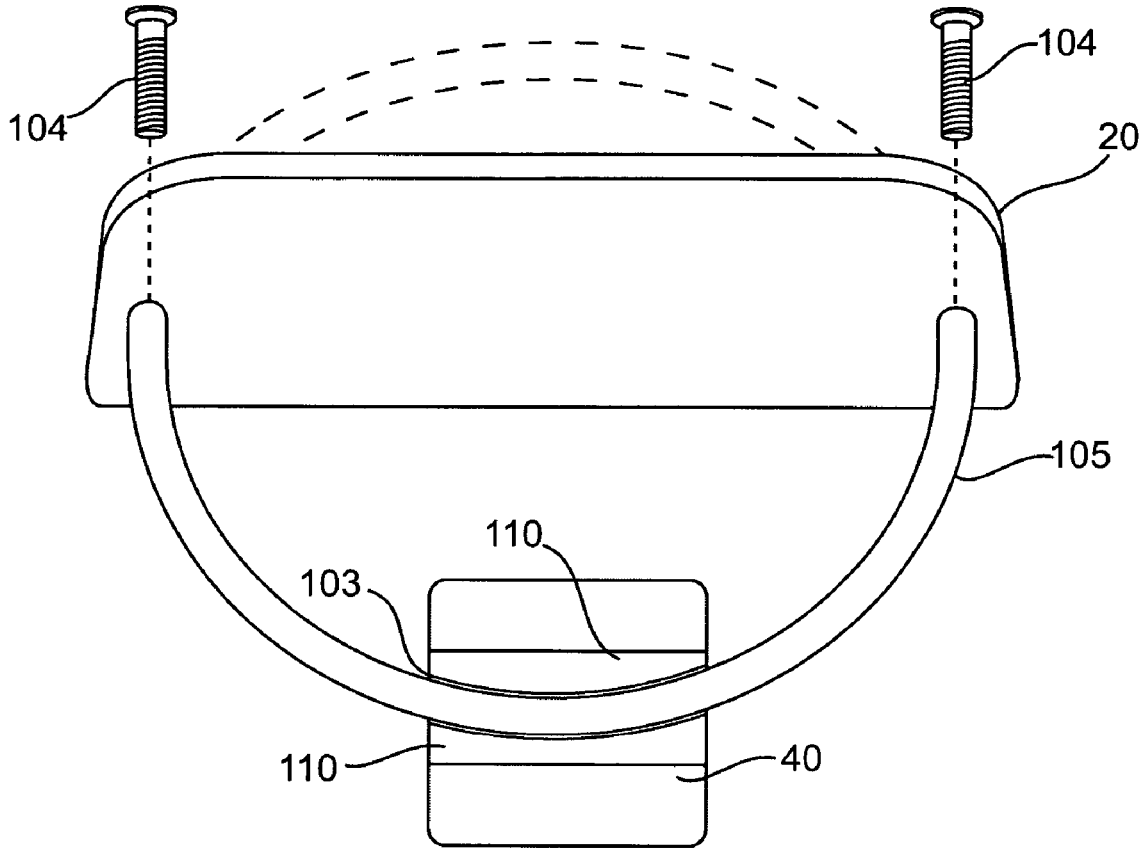
FIG. 7C shows an end view of a skateboard having an alternate truck assembly.

FIG. 7C shows a further embodiment of a skateboard truck assembly 30 attached to a skateboard deck 20. The truck assembly 30 includes a platform element 105 and a housing 110 in the form of a wheel 40. The wheel 40 includes openings 103 configured to movably receive the platform element 105. The opening 103, which is in general not cylindrical is part of the cylindrical housing 110, which is axially centered within the wheel 40 such that the wheel 40 will smoothly rotate around the cylindrical housing 110. As shown in FIG. 7C, bolts or screws 104 attach the platform element 105 to the skateboard deck 20. The bolts or screws 104 are preferably strong enough to allow the structural stability required to maintain the position of the platform element 105 relative to the skateboard deck 10. The platform element 105 may be attached to the deck 20 with pins, flexible fasteners, pivoting fasteners, welding, or any other suitable means of flexibly, rotationally, or fixedly attachment without deviating from this invention.

Figure 8:
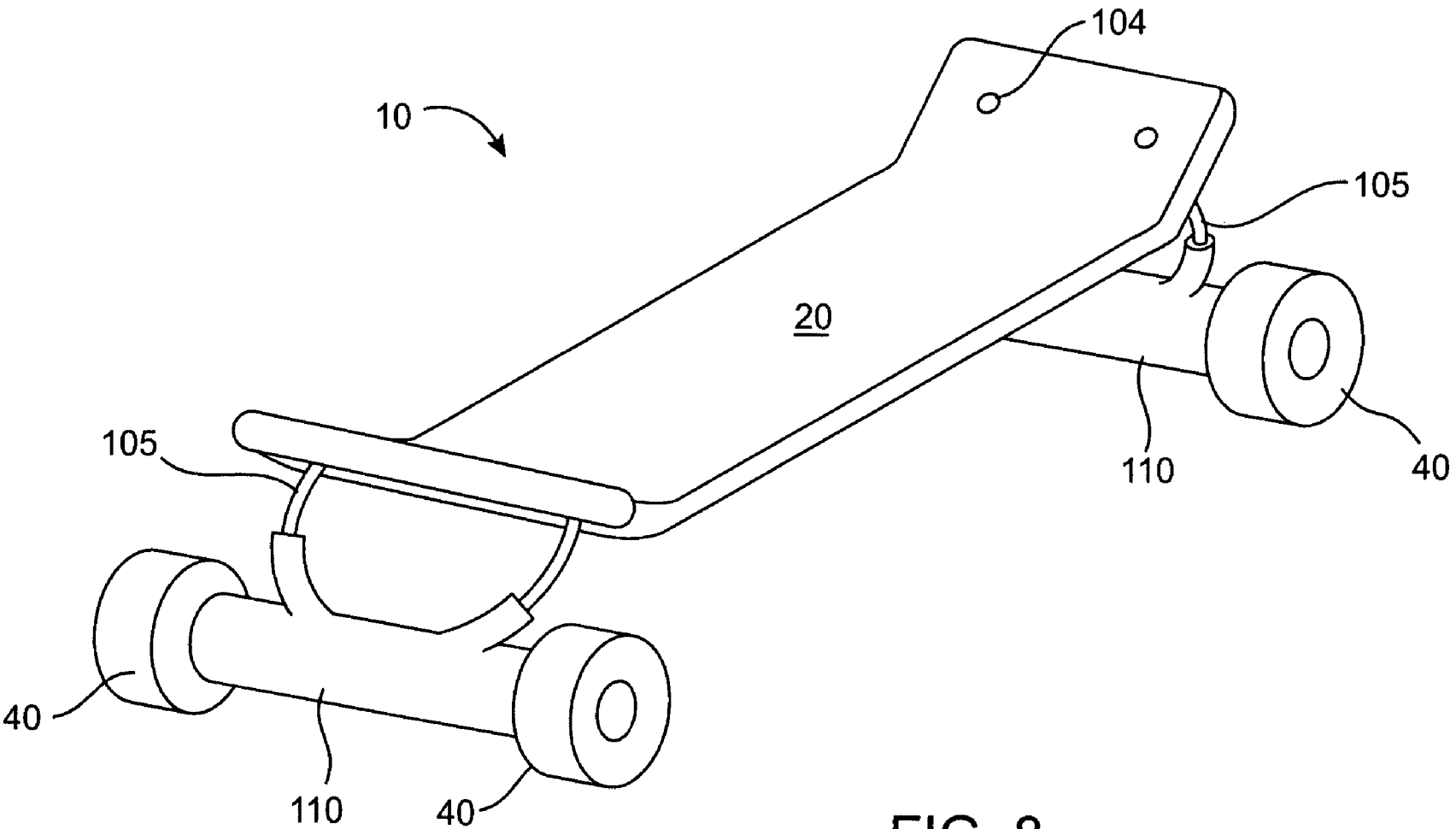
FIG. 8 shows a perspective view of the skateboard of FIG. 7A or 7B shown in a configuration to illustrate a straight path geometry.

FIG. 8 shows a perspective view of a skateboard 10 including the truck assembly 30 as described in FIGS. 7A and 7B. As shown in FIG. 8, the skateboard 10 is shown at rest, or traveling without a rider along a straight path.

Figure 9:
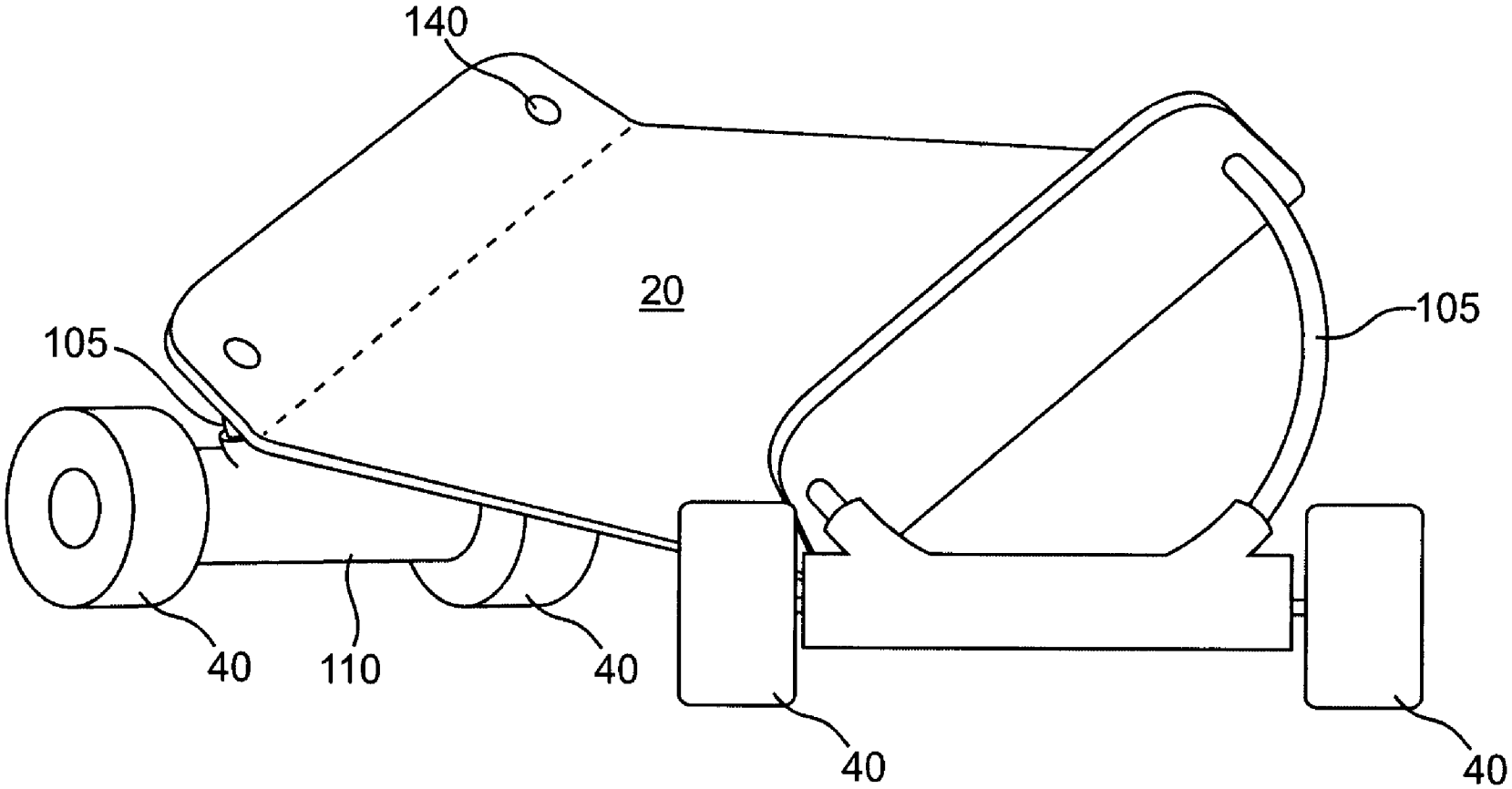
FIG. 9 shows another perspective view of the skateboard of FIG. 7A or 7B shown in a configuration to illustrate a turning geometry.

FIG. 9 shows a perspective view of a skateboard 10 including the truck assembly 30 described in FIGS. 7A or 7B. As shown in FIG. 9, the skateboard 10 is shown in a turning configuration wherein there is a non-zero deck-dipping angle, theta (θ in FIG. 3) and non-zero turning response angle, beta (β in FIG. 4).

The geometric configuration of the truck assembly 30 as shown in FIGS. 7A, 7B, 8, and 9 offer several significant improvements over other truck designs. For example, issues of speed wobble should be significantly reduced due to the broader distribution of structural support between the deck 20 and the ground surface. The shape of the platform element 105 and the angle at which it is mounted to the deck 20 can be altered, along with the associated opening 103 within the axle housing 110, to provide a variety of turning responses for different deck dipping angles. In addition, the energy generated by the rider while turning or steering the skateboard 10 in this embodiment is transferred through the structural elements, as differential motion of the platform element 105 relative to the axle housing 110.

In further embodiments to be described below, the relative motion between the platform element 105 and axle housing 110 can be converted into power for the locomotion of the skateboard 10. It is significant that other structural elements, which support the weight of the rider, are removed. Power transferred by the rider into systems designed for the locomotion of the skateboard can be maximized if the structural elements used to support the load generated by the rider are also used to transfer the generated power. This design is significant in that it solves several problems inherent in many existing truck designs, while offering means to maximize the transfer of energy generated by riding and turning the skateboard into the energy which may be used in the locomotion of the skateboard. Additionally this transmitted energy can also be used to perform a variety of auditory, visual, or other sensory effects. It is of great significance that the structural load is carried by platform element 105, for without additional means of supporting the weight, muscular power, and centrifugal force generated through the riding of the board, such energy transmitted through the structural platform element 105 is maximized and may be used for a variety of other function including, but not limited to the locomotion, braking, and steering enhancement of the skateboard, wheeled platform, etc.

Figure 10:
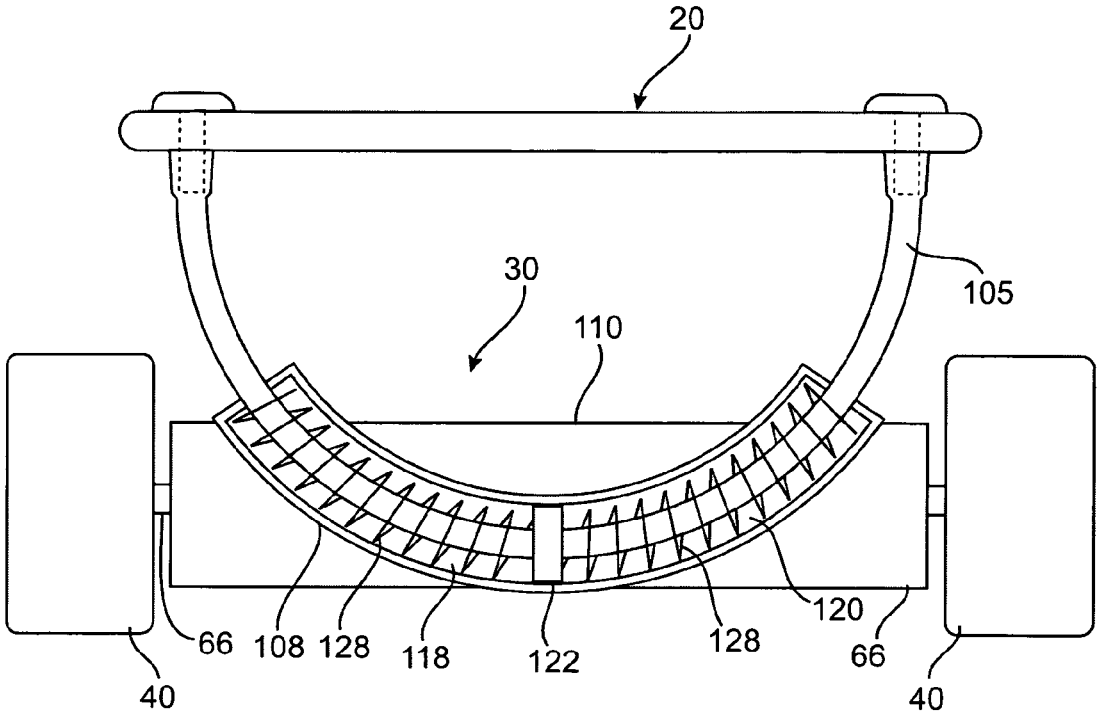
FIG. 10 shows an end view of a skateboard having an alternate truck assembly, which includes a cutaway view of internal parts, which include hydraulic components.
Figure 11:
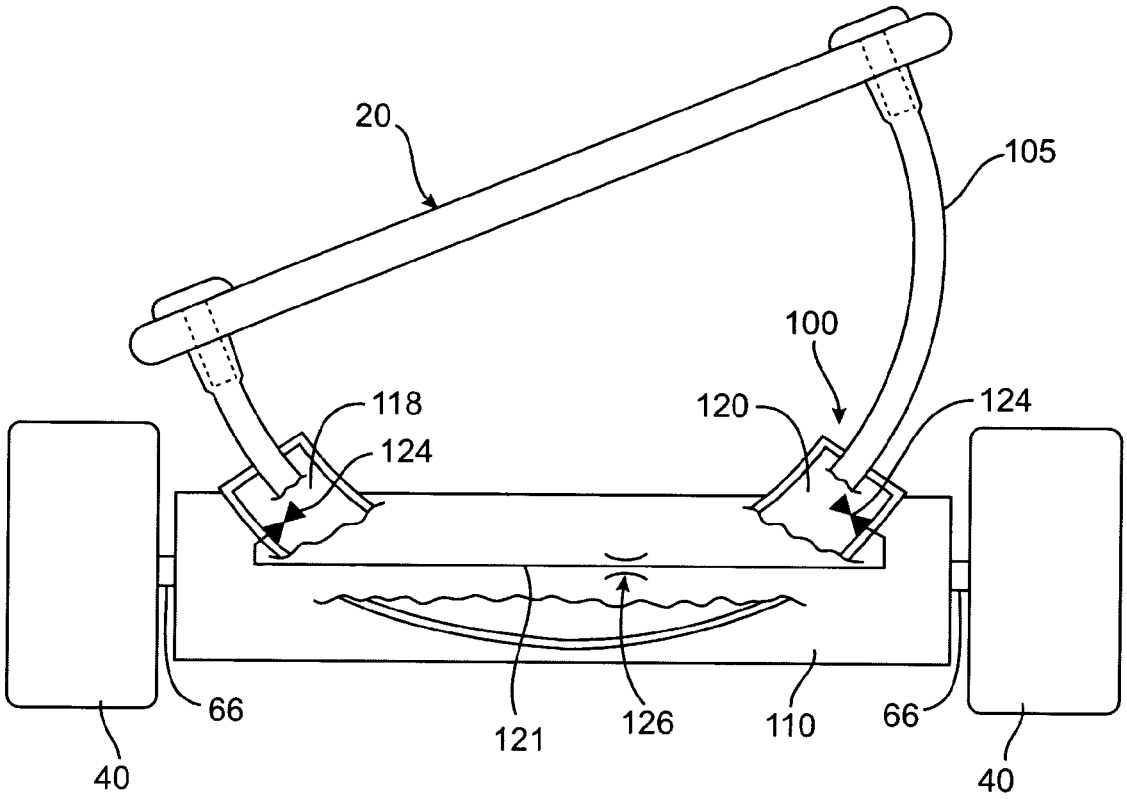
FIG. 11 shows a partial cutaway end view of a skateboard having the truck assembly of FIG. 10 showing schematic hydraulic circuitry.

FIGS. 10 and 11 are cutaway end views of an alternative truck assembly 30 mounted on a skateboard 10 having a hydraulic system 100. As shown in FIGS. 10 and 11, the truck assembly 30 embodies the truck geometries in FIGS. 7A and 7B with a hydraulic system 100. It can be appreciated that any suitable hydraulic system 100 can be used with the embodiment as shown in FIGS. 10 and 11.

FIG. 10 shows a cross sectional view of the truck assembly 30 attached to the skateboard 10, which is at rest with a horizontal skateboard deck 20. FIG. 11 shows the skateboard 10 of FIG. 10 with the deck 20 of the skateboard 10 dipping to the left and a cutaway schematic of the truck assembly 30 showing hydraulic circuitry symbols which describe the movement of hydraulic fluids within the hydraulic system.

As shown in FIG. 10, the curved housing 108 is a hydraulic chamber 118, 120 adapted to displace a hydraulic fluid from one of the hydraulic chambers 118 to the other hydraulic chamber 120. The housing 108 can also comprise a piston 122 configured to separate the at least one hydraulic chamber into the two separate hydraulic chambers 118, 120. The at least two chambers 118, 120 are in fluid communication with each other through a single conduit 121 (FIG. 11), which connects to an inlet/outlet port 124 in each chamber 118, 120.

The movement of the deck 20 from a first position to a second position (i.e., side to side, or up and down) causes the platform element 105 to displace a hydraulic fluid from one of the at least two hydraulic cylinder chambers 118, 120 to the other hydraulic cylinder chamber 118, 120, which expands to receive the hydraulic fluid and can dampen or eliminate the speed wobble vibrations to varying degrees by restricting the size of the fluid conduit, which connects the two chambers 118, 120, which a skateboarder can experience as a result of the speed of the skateboard 10. It can be appreciated that the wheeled platform in the form of a skateboard 10 may be propelled by the rider in immediate response to the steering or movement of the skateboard deck 20, whether turning left or right by providing torque to the drive axle in response to the compression of the hydraulic cylinder or hydraulic cylinders located symmetrically across a longitudinal axis of the platform in the form of a skateboard deck 20 or alternatively, the skateboard can be propelled in delayed response to the steering of the skateboard and the change of the contact point of the platform element 105 relative to the housing 110.

In this embodiment, the platform element 105 is preferably a single double-ended-piston-rod contained within a spring-centered hydraulic cylinder 108; however, it can be appreciated that other types of cylinder arrangements can be used. It can also be appreciated that it is not necessary to use a curved hydraulic housing 108 and that other housing 108 configurations can be used.

As shown in FIGS. 10 and 11, the platform element 105 is adapted to displace a hydraulic fluid from one of the hydraulic chambers 118 to the other hydraulic chamber 120 when compressed, after passing through the housing 108 via the conduit 121, which connects the two chambers 118, 120. It can be appreciated that the conduit 121 can be a flexible or rigid hydraulic conduit, which can be located internal or external to the housing 108. Additionally, the conduit 121 can be designed with an adjustable restrictor valve 126 to dampen or restrict the rate at which the hydraulic fluids flow from one chamber 118 to the other chamber 120. The two chambers 118, 120 are separated by the movable piston 122, which separates the two chambers 118, 120 of the truck assembly 100 from each other. It can be appreciated that the hydraulic fluid can be any suitable liquid or gas including but not limited to water, mineral oil, or oil.

It can also be appreciated that the hydraulic system can be replaced with a similar pneumatic system using air or other suitable gas as a replacement for the liquids. Pneumatic embodiments of these devices may or may not require fluid or gaseous communication between the chambers 118, 120.

Each of the two chambers 118, 120 may further include a spring-like element 128 configured to provide resistance within the chambers 118, 120 within the housing 108, when the hydraulic fluid is being displaced from one chamber 118 to the other chamber 120. Any suitable spring-like or resistive device can be used within or external to the hydraulic chambers 118, 120 without departing from the present invention.

Gravitational force, centrifugal force and the force derived from the dipping of the deck 20 to the left or the right or up and down will actuate the truck assembly 30. In operation, one of the chambers 118 of the truck assembly 30 compresses, while the other chamber 120 of the truck assembly 30 expands forcing the hydraulic fluid from the compressed hydraulic cylinder chamber 118 into the expanding hydraulic cylinder chamber 120. The expanding hydraulic cylinder chamber 118 creates a volume of reduced pressure to suction the hydraulic fluid into the hydraulic cylinder chamber 120.

As shown, the conduit 121 connects the two chambers 118, 120 to one another and can be contained within the housing 108, or alternatively, the conduit 121 can be positioned outside of the housing 108 in either the axle housing 110 or entirely outside or either housing 108, 110.

It can be appreciated that the skateboard 10 comprising a single double-ended-piston-rod-truck assembly 30 as shown in FIGS. 10 and 11 can be designed without an axle housing 110. If the truck assembly 30 does not include an axle housing 110, the cylinder housing 108 further comprises the conduit 121 for flow between the two chambers 118, 120 of the cylinder housing 108 and at least one axle extension 66.

The configuration of the truck assembly 30 described above and shown in FIGS. 10 and 11 can be extended to incorporate the hydraulic and pneumatic variations described in U.S. patent application Ser. No. 10/874,134, filed Jun. 21, 2004, and incorporated herein in its entirety.

Figure 12:
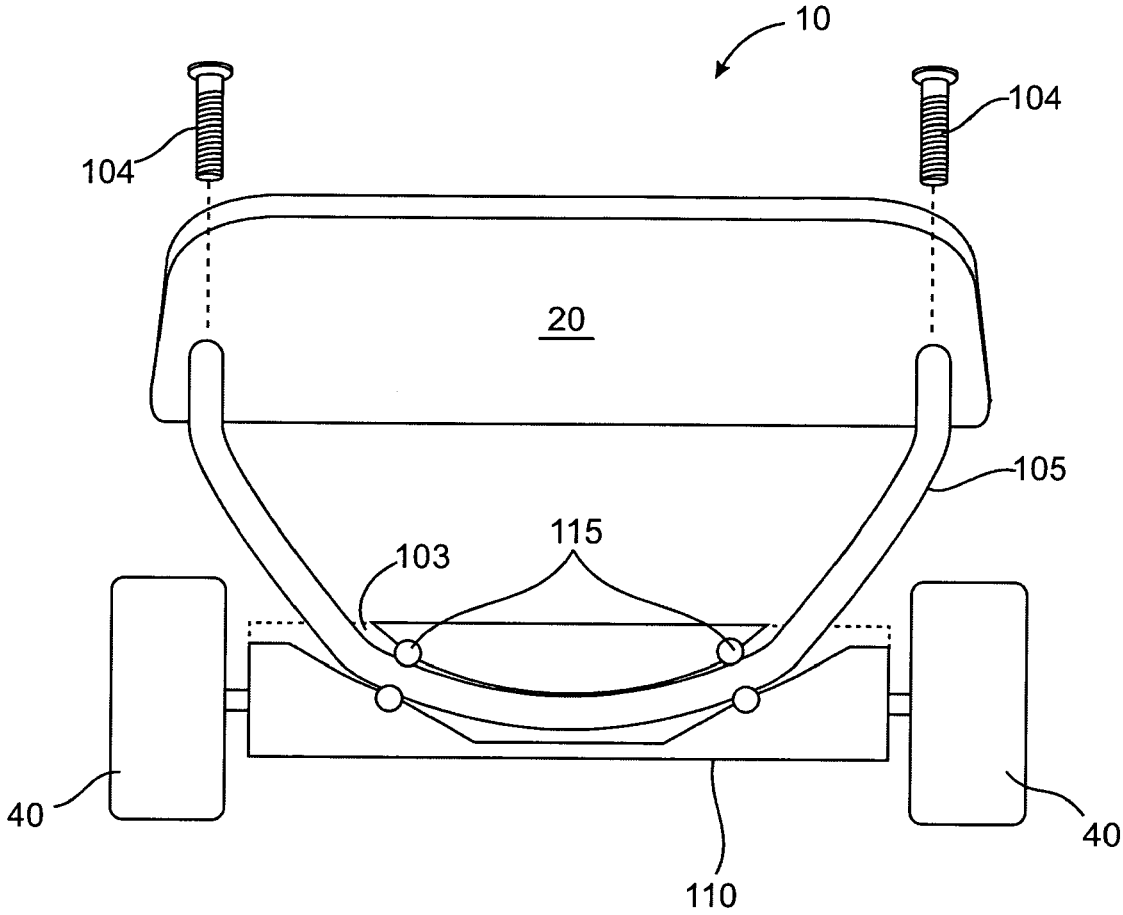
FIG. 12 shows an end view of a skateboard with an alternate truck assembly illustrating one example of non-circular shapes for a platform element.

FIG. 12 shows a cross sectional end view of an alternative truck assembly 30 attached to a skateboard 10. FIG. 12 illustrates that the platform element 105 does not need to be limited to a semi-circular shaped edge or be contained entirely within a two-dimensional plane. The platform element 105 may have any shape, with or without other elements, so long as the means by which it is movably connected to the axle housing 110 and the axle housing opening 103 is adapted to receive the unique shape of the platform element 105. Any suitable guide device 115, such as roller bearings, bearings, or guide system can be used to guide the movement of the uniquely shaped platform element 105 within the housing opening 103.

Figure 13:
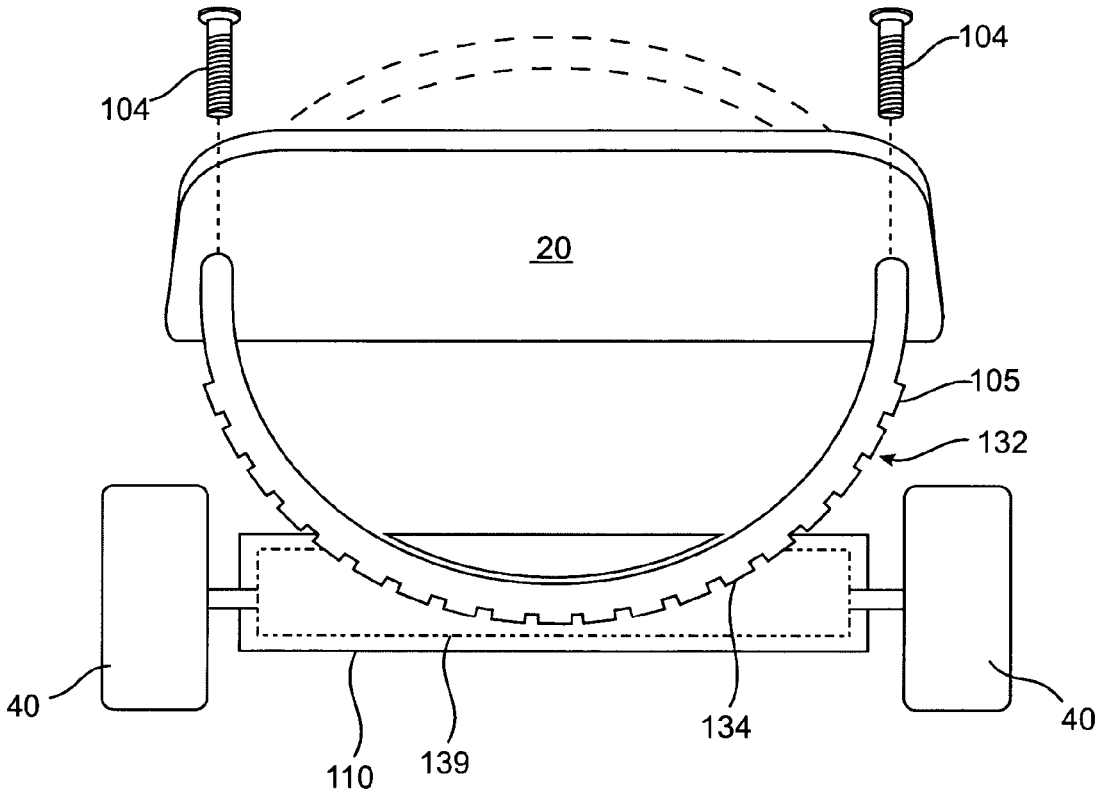
FIG. 13 shows an end view of a skateboard with an alternate truck assembly including mechanisms to create locomotion of the skateboard.

FIG. 13 shows an alternative embodiment of the truck assembly 30 with the same semi-circular geometry of the embodiment shown in FIGS. 7A and 7B, wherein the platform element 105 is configured to engage the housing 110 to propel the wheeled platform. As shown in FIG. 13, the platform element 105 comprises a gear system 132 having a series of gear teeth 134. Note that the location of the teeth 134 on the platform element 105 can be located on any or all surfaces of the platform element 105. It can be appreciated that the platform element 105 can engage the housing 110 to propel the wheeled platform by any suitable mechanism including but not limited to grooves within the platform element, and/or friction between the platform element 105 and the housing 110 or one or more mechanisms 139, which transmit energy from the platform element 105 into other functions, including but not limited to locomotion of the skateboard 10. Alternatively, magnetic attraction, rubberized platform element 105, a sprocket and derailleur system, or any other suitable system wherein the mechanical and/or rotational energy of the platform element 105 is converted into energy in the form of rotational energy to drive the wheels 40 of the platform or other device.

Additionally, as shown in FIG. 13, one or more mechanisms 139 can be added internally and/or externally to the axle housing 110, to convert the rotational motion of the geared platform element 105 into other functions, including, but not limited to the locomotion of the skateboard. It can also be appreciated that, as in the embodiment described in FIG. 12, irregularly shaped platform elements for the truck assembly 30 described in FIG. 13 may be used instead of semi-circular platform elements 105 without deviating from this invention.

Figure 14:
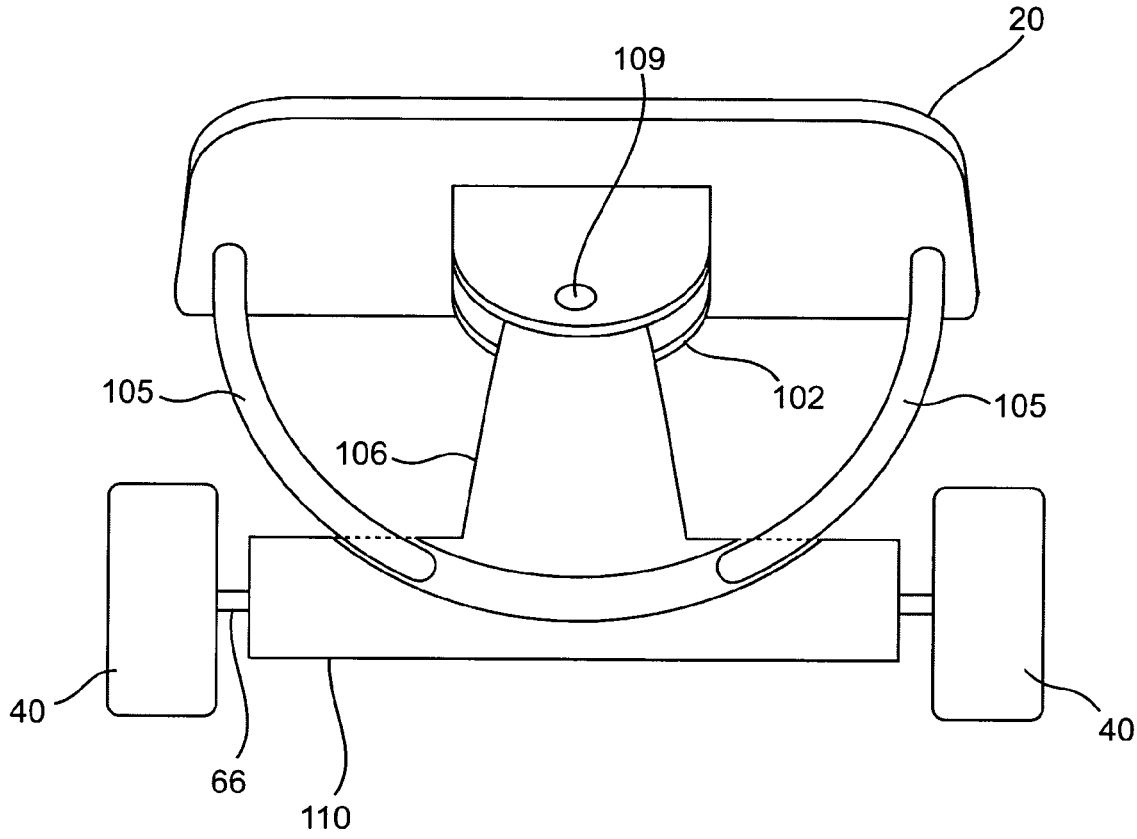
FIG. 14 shows an end view of a skateboard with an alternate truck assembly.

FIG. 14 shows that the platform element 105 is not necessarily limited to a single piece of any particular shape. The platform element 105 can be constructed of any material, any number of pieces, any shape and design so long as it maintains a function of providing a means of generating differential motion between the deck 20 and the axle housing 110. If the platform element 105 loses it function of contributing to the structural support of the rider, then other structural elements must be added. For example, a means of structurally mounting the housing 110 to the platform 20 can be added. The means of structurally mounting the housing 110 to the platform 20 can be a truck assembly 30 as shown in FIG. 14 or any other suitable support member.

Figure 15:
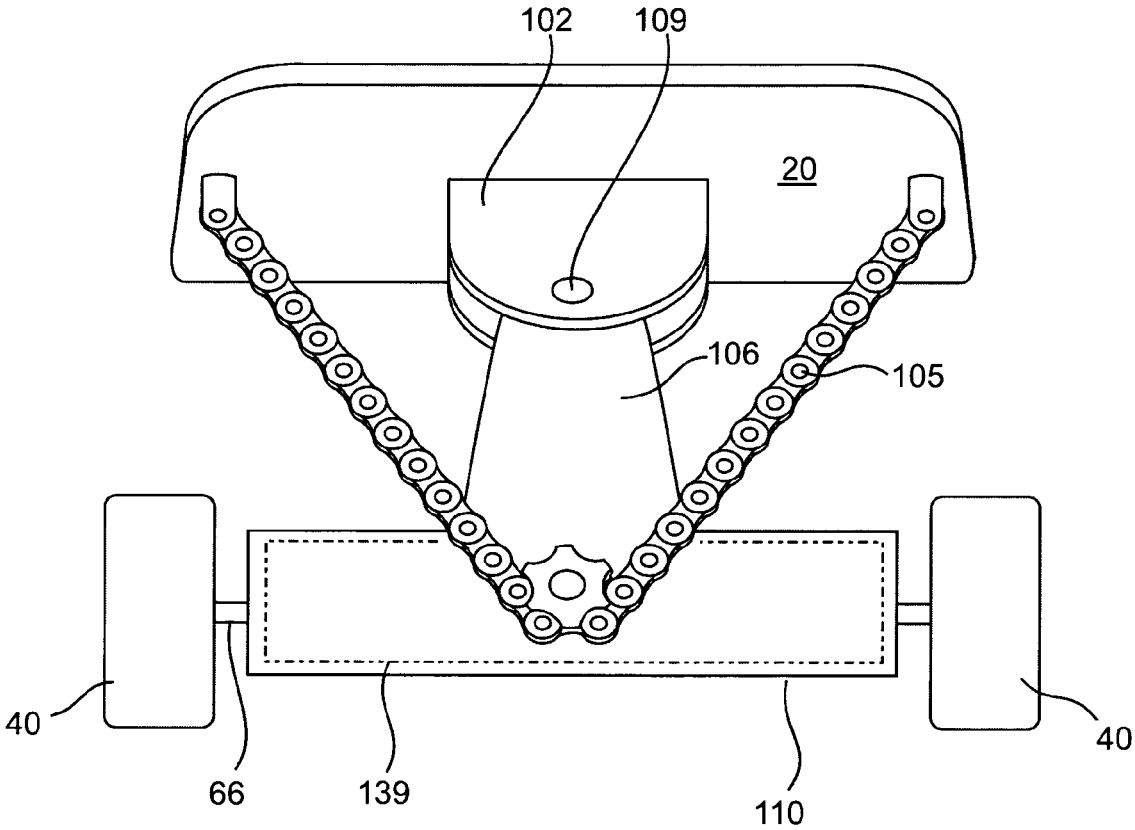
FIG. 15 shows an end view of a skateboard with an alternate truck assembly.

FIG. 15 shows that the connection points for the platform element 105 do not need to be structural or fixedly attached. They can be flexibly or rotationally attached to the deck 20. FIG. 15 also illustrates that the platform element 105 can be a cable, rope, elastic, or chain, like a bicycle chain (not structural) that engages mechanisms on, or in, the truck housing 110. It also can be appreciated that an occupant generated or alternative energy source 138 (FIG. 18) can be incorporated into the housing of the truck assembly 30 without departing from the invention.

Figure 16:
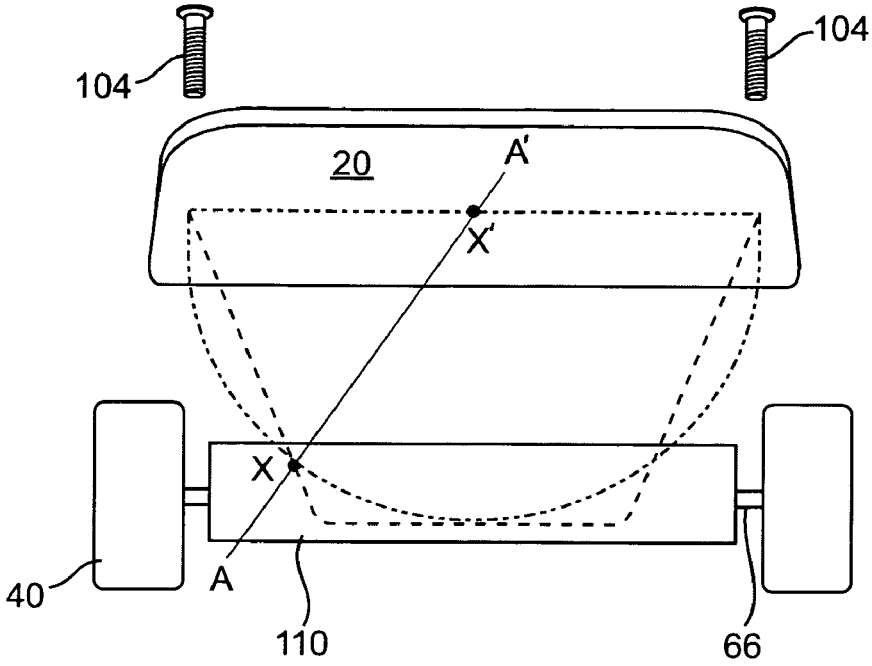
FIG. 16 shows an end view of a skateboard with various truck component geometries.

FIG. 16 shows that the platform element 105 can have any radial cross sectional shape (cross section plane which includes the axis of rotation, for example, of a semi-circular shaped platform element 105). For example, the platform element 105 may be solid, t-shaped, circular, etc. In addition, it can be appreciated that the cross sectional shape for any given platform element 105 may differ for different radial cross sections of the same platform element 105.

Figure 17:
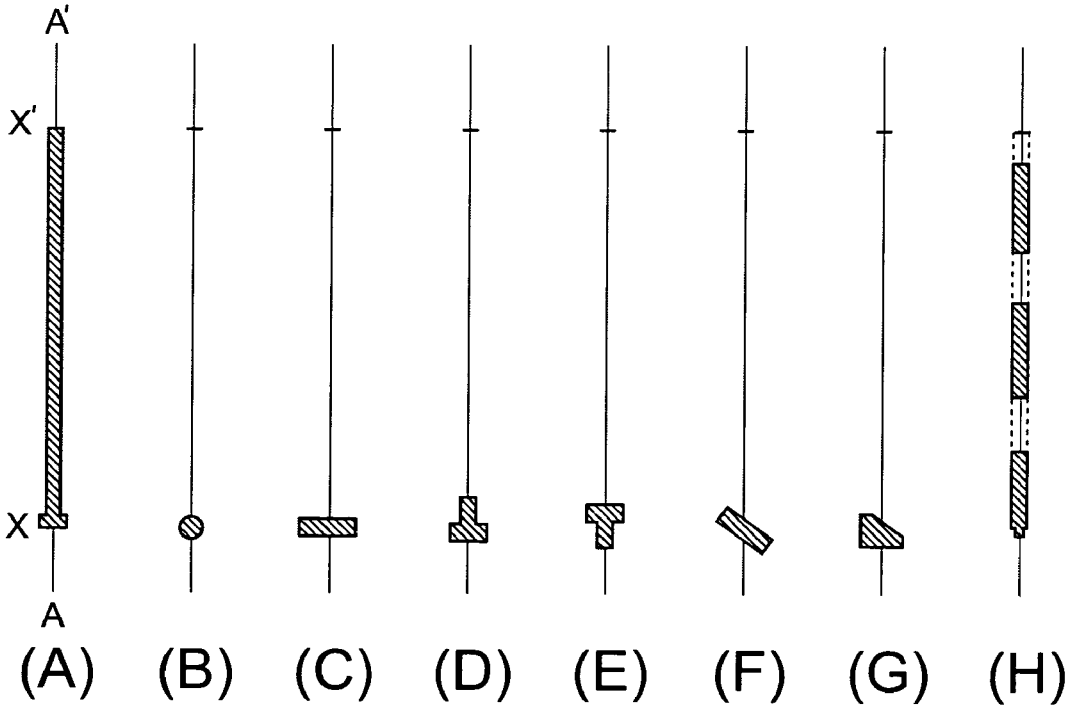
FIGS. 17A-17H show various cross sectional views of a platform element taken along line A-A' of FIG. 16.

FIGS. 17A-17H show various cross sectional views of FIG. 16 within the plane of the platform element 105 taken from a side view. As shown in FIGS. 17A-17H, the platform element 105 can have a solid inverted t-shape, wherein the inverted t-shape extends from X' to X (FIG. 17A), cylindrical having a circular or round cross section (FIG. 17B), bar or hoop shaped having a rectangular cross section (FIG. 17C), an inverted t-shaped cross section (FIG. 17D), an up right t-shape cross section (FIG. 17E), an angled bar or hoop shape having a rectangular cross section (FIG. 17F), an triangular cross section with a portion of each end removed (FIG. 17G), a solid plate having a plurality of holes or sprockets and a toothed gear (FIG. 17H). It can be appreciated that the platform element 105 can have any suitable cross sectional geometry or configuration.

Figure 18:
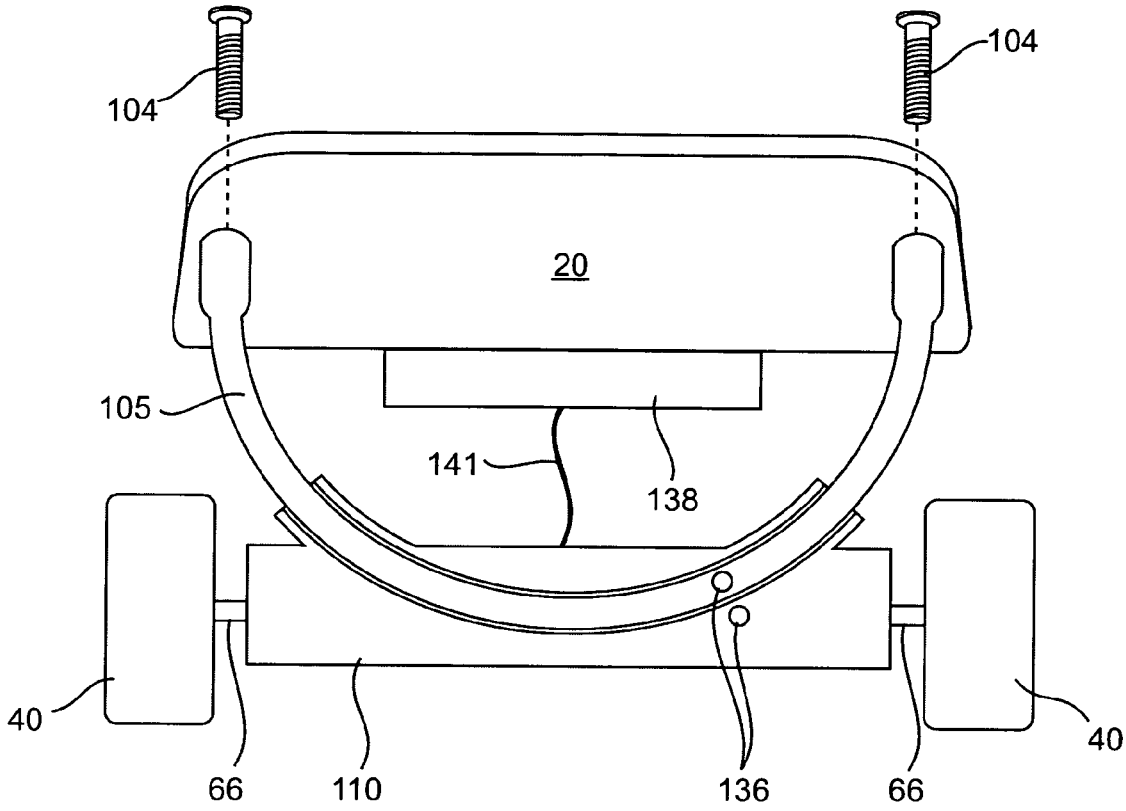
FIG. 18 shows an end view of a skateboard with an alternate truck assembly including sensors and alternate energy sources.

FIG. 18 shows how the platform element 105 and/or truck housing 110 can be equipped with at least one sensor 136, which is configured to detect the relative motion of the deck 20 and attached platform element 105 relative to the truck housing 110. Such sensory information can then be used to control (mechanically, or electronically or otherwise) the distribution of occupant generated or alternate energy source 138. For example, the occupant generated or alternative energy sources 138 can be a battery, an internal combustion engine, or hydraulically or pneumatically accumulated energy. The occupant generated or alternate energy source 138 is attachable to the housing 110 via a suitable connection 141.

Figure 19:
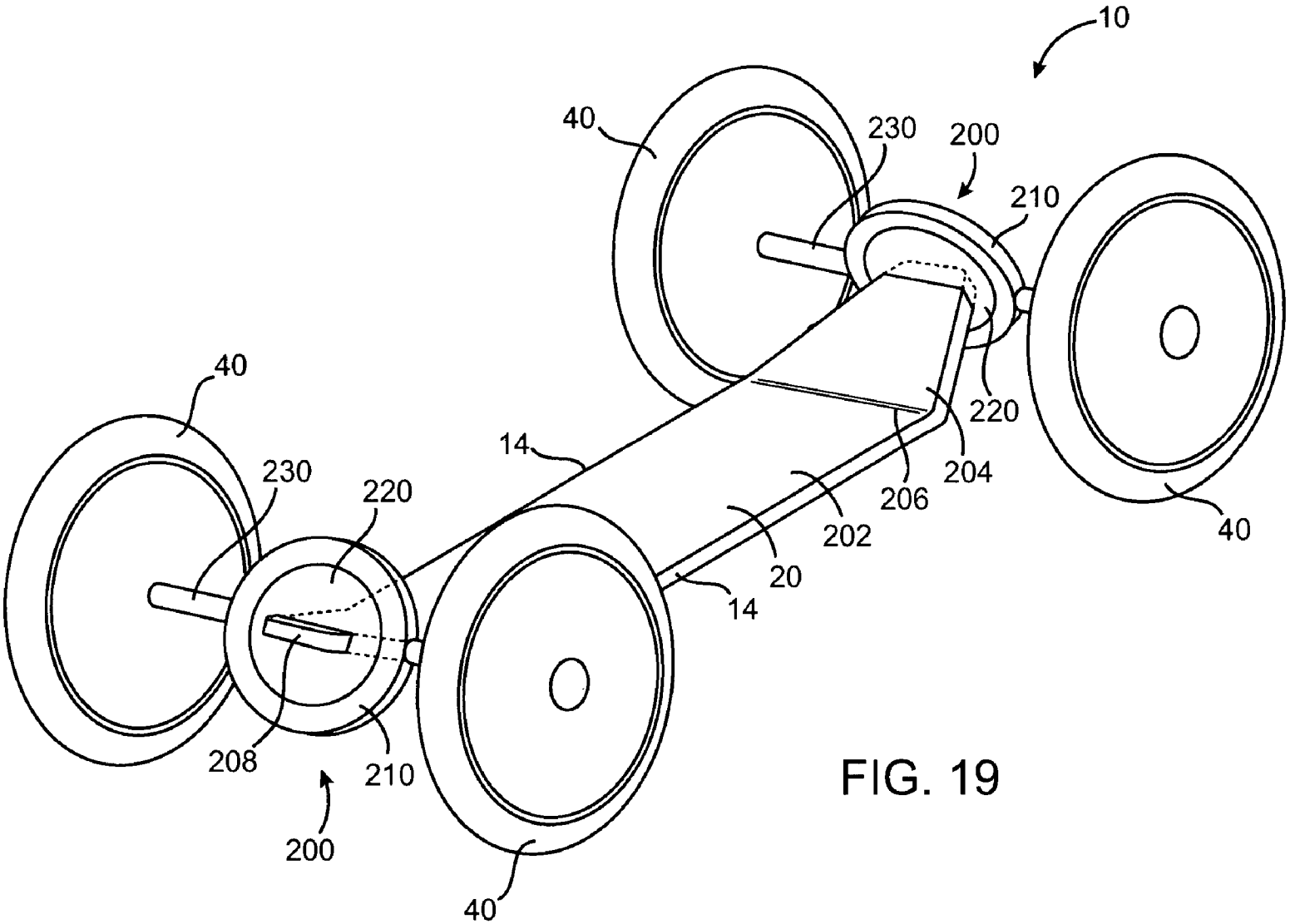
FIG. 19 shows a perspective view of another embodiment of a truck assembly and skateboard.

FIG. 19 shows a perspective view of a skateboard 10 and a truck assembly 200 according to another embodiment. As shown in FIG. 19, the skateboard 10 comprises a deck 20, a pair of truck assemblies 200, and a plurality of wheels 40. The skateboard deck 20 or platform includes a horizontal or first portion 202 and a pair of flared ends 204. The deck 20 of the skateboard 10 transitions from the relatively horizontal or flat first portion 202 to the pair of flared ends 204 towards each end of the deck 20 at a pivot or transition point 206. The pivot or transition point 206 can have any suitable angle of transition 209 (FIG. 22) and is preferably between about 0 and 60 degrees. As shown in FIG. 19, the flared end 204 of the skateboard deck 20 is configured to receive the truck assembly 200.

The truck assembly 200 comprises an outer ring 210 and an inner ring 220 having a bearing system 240 (FIG. 20) between the outer ring 210 and the inner ring 220. The outer ring 210 is attachable in a fixed or other suitable manner to an axle 230. The axle 230 extends outward from outer ring 210 of the truck assembly 200 and is configured to receive at least one wheel 40 on each end of the axle 230.

Figure 20:
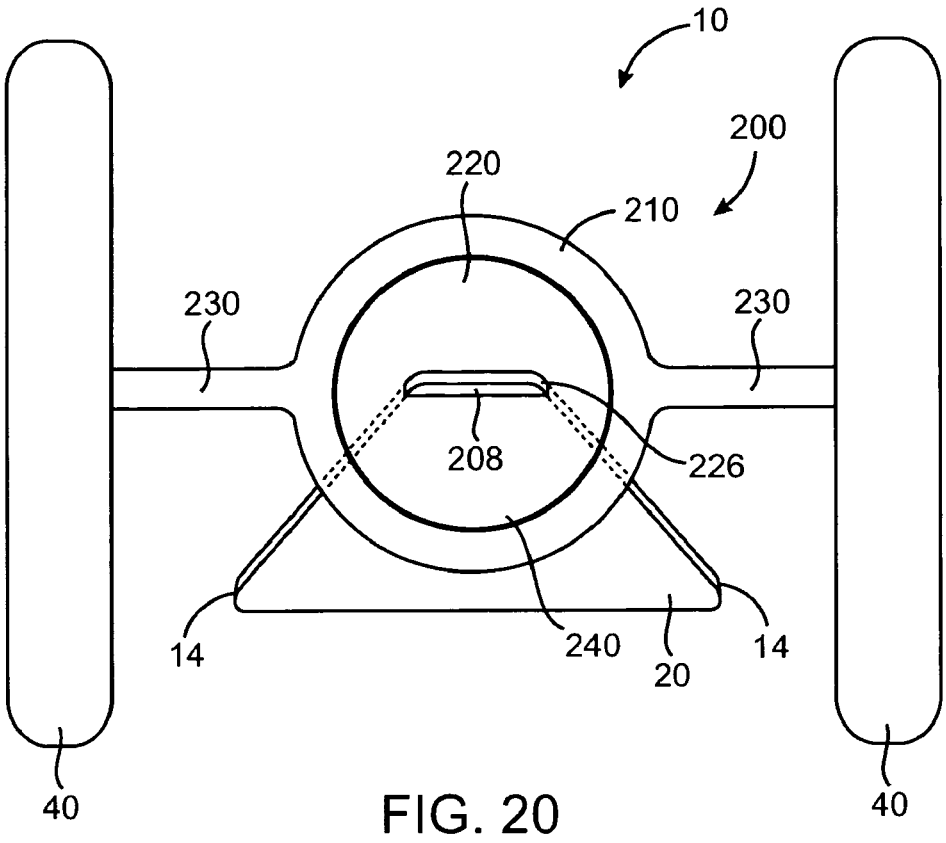
FIG. 20 shows an end view of the truck assembly and skateboard of FIG. 19.

FIG. 20 shows an end view of the truck assembly 200 and the skateboard 10 of FIG. 19. As shown in FIG. 20, the skateboard 10 includes the deck 20, a truck assembly 200 and a plurality of wheels 40. The truck assembly 200 includes an inner ring 220, which is preferably in the form of a plate having an opening 226, which is configured to receive a distal end 208 of the skateboard deck 20. The distal end 208 of the skateboard deck 20 is preferably fixed within the inner ring 220. However, it can be appreciated that the distal end 208 of the skateboard deck 20 can be attached to the inner ring 220 of the truck assembly 200 in any suitable manner including a detachable configuration so that the truck assembly 200 can be attached to any suitable skateboard deck 20.

In use, upon a change in the orientation of the skateboard deck 20, the distal end 208 of the skateboard deck 20 imparts a change in the orientation of the inner ring 220 relative to the outer ring 210. In addition, as a result of the change in the orientation of the inner ring 220 relative to the outer ring 210, the turning path of the skateboard 10 will curve or change in the direction of the edge 14 of the skateboard that has been forced downwards. It can be appreciated that when one edge 14 of the skateboard deck 20 is rotated downward by the deck dipping angle theta (θ), as shown in FIGS. 3 and 4, the ends of the axle 230 on that side of the skateboard 10 are caused to mechanically move towards one another, thus achieving the potential for the skateboard 10 to have a curved path.

The position and alignment of the axle 230 are designed to respond variably to different changes in the deck 20 dipping angle, theta (θ), of the skateboard deck 20 from a first position to a second position. The path of the skateboard 10 will curve in the direction of the edge 14 of the skateboard deck 20 that has been forced downwards. The greater the deck dipping angle, theta (θ), of the skateboard deck 20, the greater the trucks' 30 turning angle, beta (β), as shown in FIGS. 3 and 4, from their resting position and the shorter the radius of curvature, r, of the skateboards 10 path.

Figure 21:
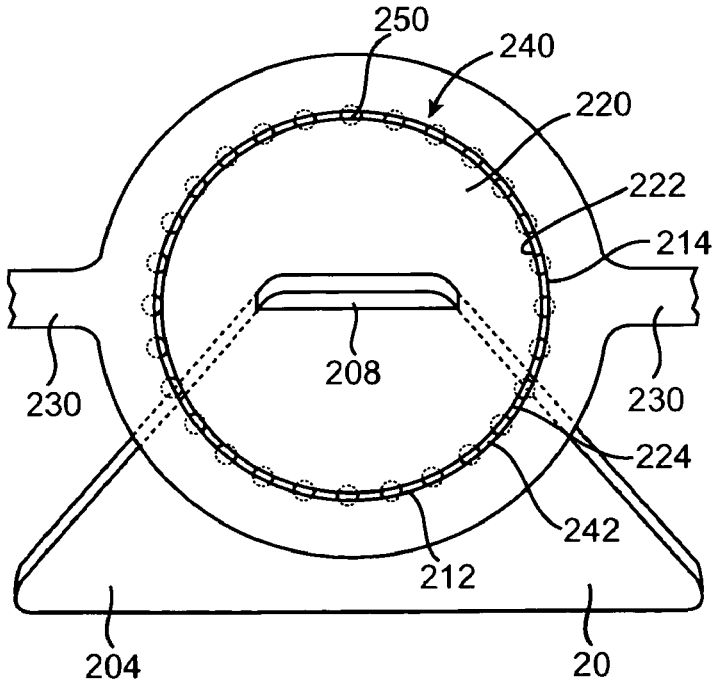
FIG. 21 shows another end view of the truck assembly of FIG. 20 showing an inner ring and an outer ring configuration.

FIG. 21 shows another end view of the truck assembly 200 of FIG. 19 showing the inner ring 220 and the outer ring 210 with a bearing system 240. As shown in FIG. 21, the bearing system 240 is positioned between a pair of grooves 222, 212 positioned on an outer portion 224 of the inner ring 220 and an inner portion 214 of the outer ring 210. The outer portion 224 of the inner ring 220 and the inner portion 214 of the outer ring 210 form a channel 242 for a plurality of bearings 250. The bearings 250 rotate within the channel 242, which allows the inner ring 220 and the outer ring 210 to rotate around one another with little or no friction.

Figure 22:
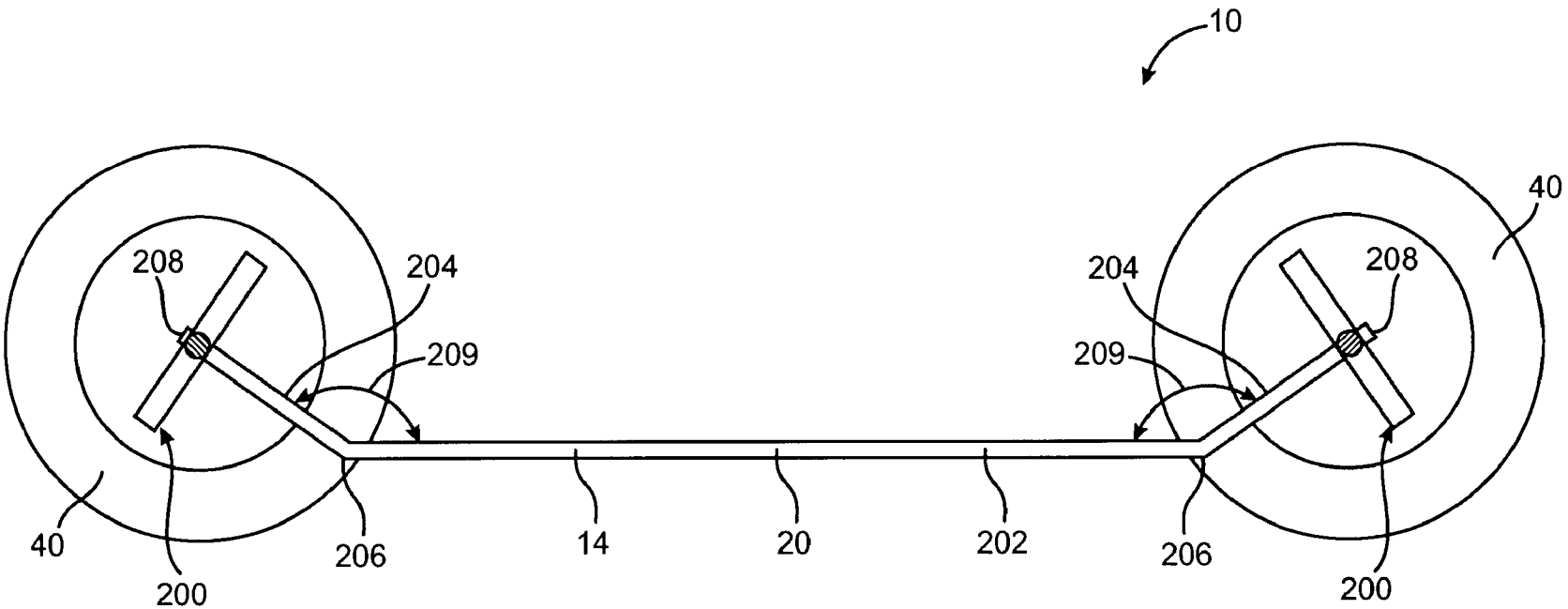
FIG. 22 shows a cross sectional view of the truck assembly and skateboard of FIG. 19.

FIG. 22 shows a cross sectional view of the truck assembly 200 and the skateboard 10 of FIG. 19 along the center axis of the skateboard 10. As shown in FIG. 22, the skateboard 10 includes the deck 20 having a pair of edges 14, a truck assembly 200 and a plurality of wheels 40. The deck 20 preferably includes a relatively horizontal or flat first portion 202 with a pair of flared ends 204. The relatively horizontal or flat first portion 202 also includes a pair of pivot or transitions points 206 having an angle of transition 209 between about 0 and 60 degrees and more preferably about 20 to 45 degrees. As shown in FIG. 22, the pivot or transition point 206 transitions the relatively horizontal portion 202 of the skateboard deck 20 to an angled or flared end 204, which receives the truck assembly 200. The distal end 208 of the skateboard deck 20 extends through the inner plate 220 of the truck assembly 200.

Figure 23:
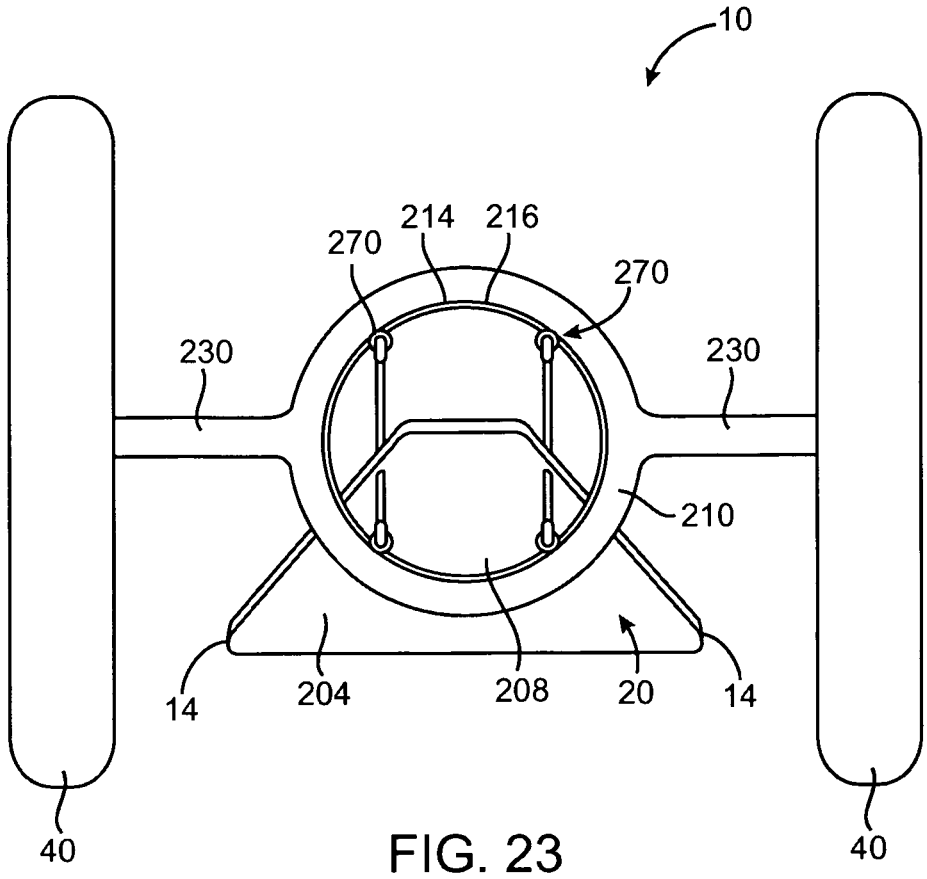
FIG. 23 shows an end view of another embodiment of a truck assembly and skateboard.

FIG. 23 shows an end view of a truck assembly 200 and skateboard 10 according to another embodiment. As shown in FIG. 23, the truck assembly 200 includes an outer ring 210 having an inner ridge 216 positioned on an inner portion 214 of the outer ring 210, and a plurality of grooved roller bearings 270. The grooved roller bearing 270 is received by the inner ridge 216 of the inner portion 214 of the outer ring 210 and allows the outer ring 210 to rotate around the plurality of grooved roller bearings 270. The inner ridge 216 is preferably a ring with a generally V-shape, which is contained with in the inner portion 214 of the outer ring 210. As shown, the plurality of grooved roller bearings 270 preferably are at least 4 and more preferably 4 to 8 and most preferably 4 to 6 in number. In addition, the grooved roller bearings 270 can be positioned symmetrically around the perimeter of the outer ring 210. However, it can be appreciated in some embodiments, the grooved roller bearings 270 will not be symmetrically positioned around the inner portion 214 of the outer ring 210. For example, as shown in FIG. 23, the grooved roller bearings 270 are positioned at the 1, 5, 7 and 11 positions relative to a clock face on the inner portion 214 of the outer ring 210.

Figure 24:
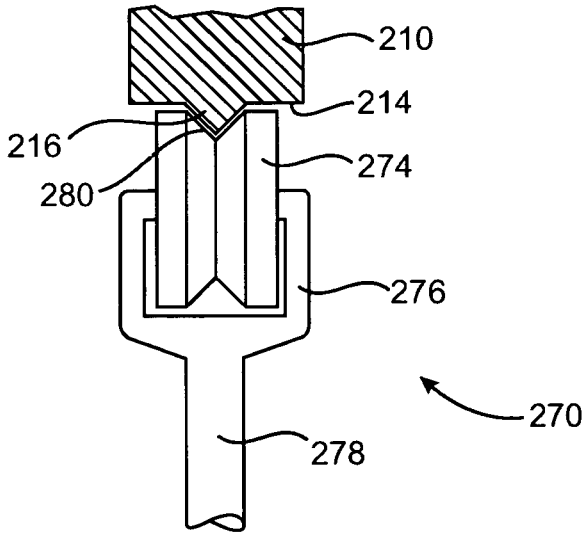
FIG. 24 shows a side view of the gearing assembly of the truck assembly and skateboard of FIG. 23.

FIG. 24 shows a side view of the truck assembly 200 including a grooved roller bearing 270 and the inner portion 214 of the outer ring 210. As shown in FIG. 24, the inner portion 214 of the outer ring 210 includes an inner ridge 216 having a generally V-shaped cross-section, which is received within a wheel 274 of the grooved roller bearing 270. The grooved roller bearing 270 also includes a base member 278 with a support member 276. The wheel 274 includes a groove 280 configured to receive the inner ridge 216 of the outer ring 210. The base members 278 are preferably attached to the flared end 204 of the deck 20 of the skateboard 10 by any suitable means including a nut and bolt combination, fixed with an epoxy and/or adhesive, or other suitable manner.

In operation, upon a change in orientation of the skateboard deck 20, the plurality of grooved roller bearings 270 rotating relative to the outer ring 210, which results in a change in the turning path of the skateboard 10 with the change of direction occurring relative to the direction of the edge 14 of the skateboard 10 that has been forced downwards.

Figure 25:
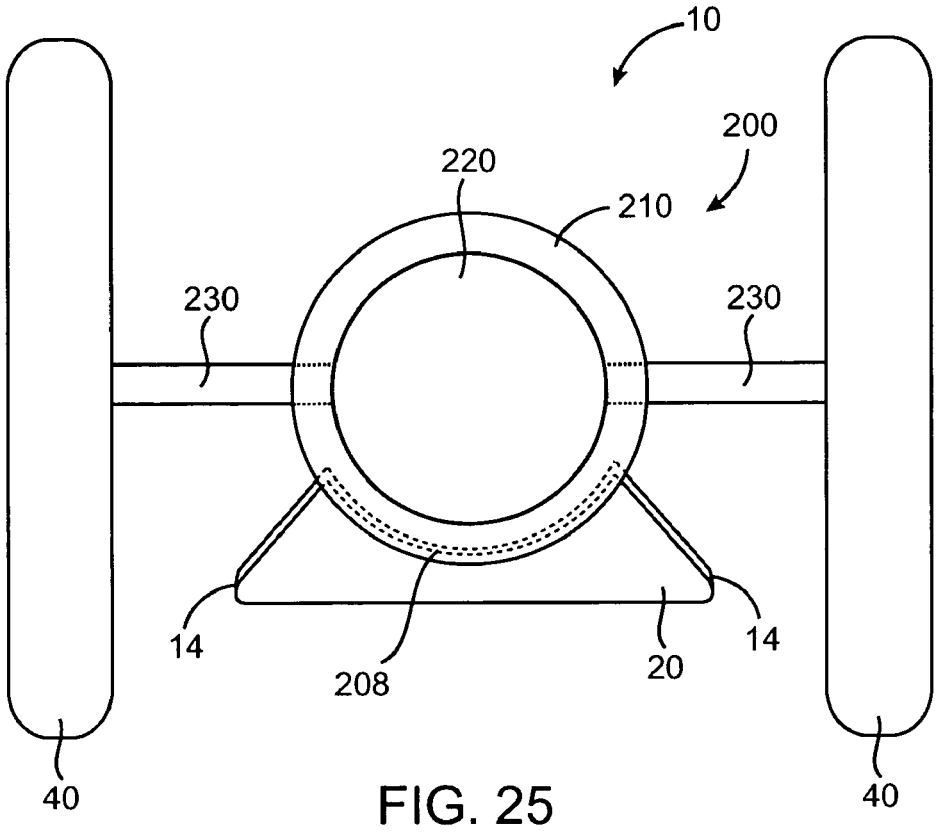
FIG. 25 shows an end view of the truck assembly and skateboard of FIG. 19 in accordance with another embodiment.

FIG. 25 shows an end view of the truck assembly 200 and the skateboard 10 of FIG. 19 in accordance with another embodiment. As shown in FIG. 25, the skateboard 10 includes the deck 20, a truck assembly 200 and a plurality of wheels 40. The truck assembly 200 comprises an outer ring 210 and an inner ring 220 having a bearing system 240 (FIG. 20) between the outer ring 210 and the inner ring 220. As shown in FIG. 25, the inner ring 220 is attachable in a fixed or other suitable manner to each end of the axle 230. The axle 230 extends outward from the inner ring 220 of the truck assembly 200 and is configured to receive at least one wheel 40 on each end of the axle 230.

In addition, the distal end 208 of the skateboard deck 20 is preferably fixed to the outer ring 210. However, it can be appreciated that the distal end 208 of the skateboard deck 20 can be attached to the outer ring 210 of the truck assembly 200 in any suitable manner including a detachable configuration so that the truck assembly 200 can be attached to any suitable skateboard deck 20.

In use, upon a change in the orientation of the skateboard deck 20, the distal end 208 of the skateboard deck 20 imparts a change in the orientation of the outer ring 210 relative to the inner ring 220. In addition, as a result of the change in the orientation of the outer ring 210 relative to the inner ring 220, the turning path of the skateboard 10 will curve or change in the direction of the edge 14 of the skateboard that has been forced downwards.

Figure 26:
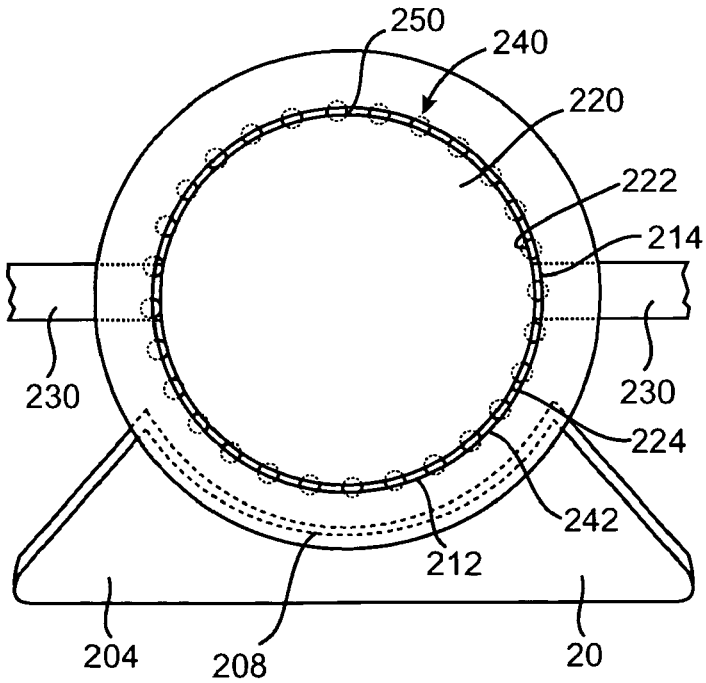
FIG. 26 shows another end view of the truck assembly of FIG. 25 showing an inner ring and an outer ring configuration.

FIG. 26 shows another end view of the truck assembly 200 of FIG. 19 showing the inner ring 220 and the outer ring 210 with a bearing system 240. As shown in FIG. 26, the bearing system 240 is positioned between in a pair of grooves 222, 212 positioned on an outer portion 224 of the inner ring 220 and an inner portion 214 of the outer ring 210. The outer portion 224 of the inner ring 220 and the inner portion 214 of the outer ring 210 form a channel 242 for a plurality of bearings 250. The bearings 250 rotate within the channel 242, which allows the inner ring 220 and the outer ring 210 to rotate around one another with little or no friction.

It can be appreciated that the truck assembly 30 as shown in FIGS. 1-26 can be further equipped with an integrated or distinct actuating element as disclosed in U.S. patent application Ser. No. 10/980,626, filed on Nov. 2, 2004, which is incorporated herein in its entirety. The actuating element transfers lateral or transverse forces and displacements, directed roughly perpendicular to the longitudinal axis of the skateboard deck to which the truck is mounted, into enhanced turning geometries on the truck and/or skateboard braking capacity. Alternatively, the truck assembly 30 can be equipped with an integrated or attachable actuating element, which transfers lateral or transverse forces and displacements, directed roughly perpendicular to the longitudinal axis of the skateboard deck 20 to which the truck assembly is mounted, into enhanced turning geometries on the truck assembly 30 and/or skateboard braking capacity.

Although the deck 20 has been shown to be a skateboard deck, it can be appreciated that the deck 20 can be a platform such as a plain deck for moving furniture and other items, or an in-line skate where the wheels with a flat footprint remain in contact with the road by the inline boot leaning from left to right and vice-versa creates a force that is converted to rotational force within each of the in-line skates. Additionally, the platforms 20 may be bicycle pedals and the truck assembly 30 may be integrated into other bicycle components used for the locomotion of the bicycle. The platforms 20 do not necessarily require foot actuation. It is possible that energy transmitted to the truck assembly 30 via the platform element 105 be generated by any other human body part or non-human alternate energy source.

It can also be appreciated that the platform element 105 and housing 110 can be implemented into any suitable device, wherein a change in orientation, contact point and/or relationship between the platform 105 element and the housing 110 is desired. For example, the platform element 105 and housing 110 can be implemented into an automobile, wherein the platform element 105 is attachable to the chassis of the automobile and upon a change of direction of the automobile, the orientation and relationship of the platform element 105 and housing 110 provides improved handling and ride of the automobile. It can be also appreciated that the platform element 105 and housing 110 can be implemented into any suitable device or apparatus, wherein the a change in the orientation between the platform element 105 and the housing 110 is desired, including but not limited to an automobile chassis or a car seat.

The devices, platforms and skateboards 10 as shown among FIGS. 4-24 can be equipped with one truck assembly 30 as described herein and one standard truck, or with two truck assemblies 30 as described herein. Although as shown in FIGS. 1-24, the platform or skateboard 10 is a single unit, the platform or skateboard deck can be multiple platforms or decks without departing from the present invention. It also can be appreciated that the mechanisms configured to convert motion of the platform element 105 relative to the housing 110 into energy to propel the wheeled platform or including any torque generating mechanisms can be entirely located within the skateboard wheel 40 rather than within the truck assembly 30.

The truck assembly 30 system can also be applied to other human powered devices, such as motors to drive pumps, pottery wheels, wheeled equipment to move office or work equipment, hand trucks, or any device that can benefit from the rotational energy, including sewing machines or ice cream makers. In addition, it can be appreciated that the system can be incorporated into an inline skate, roller skate, or any device comprising a plurality of wheels.

While the invention has been described with reference to the preferred embodiments described above, it will be appreciated that the configuration of this invention can be varied and that the scope of this invention is defined by the following claims.

The invention claimed is:

1. A truck assembly for a skateboard comprising:

an inner ring adapted to be attachable to a skateboard deck, wherein the skateboard deck includes a horizontal portion and a pair of flared ends;

an outer ring adapted to be attachable to an axle extending from the outer ring, wherein the axle is configured to receive at least one wheel, and wherein the inner ring and the outer ring rotate relative to one another upon a change in an orientation of the skateboard deck; and wherein the flared end of the skateboard deck is attached to the inner ring of the truck assembly in any suitable manner including a detachable configuration so that the truck assembly can be attached to any suitable skateboard deck.

2. The assembly of claim 1, wherein the change in the orientation of the skateboard deck results in the inner ring rotating relative to the outer ring, which results in a turning response of the skateboard.

3. The assembly of claim 1, wherein the inner ring has an inner groove on an outer portion of the inner ring.

4. The assembly of claim 3, wherein the outer ring has an inner groove on an inner portion of the outer ring.

5. The assembly of claim 4, further comprising a plurality of bearings within the inner groove of the inner ring and the inner groove of the outer ring.

6. The assembly of claim 1, wherein the skateboard deck transitions from the horizontal portion to the pair of flared ends towards each end of the deck at a transition point having an angle of transition of between about 0 and 60 degrees.

7. The assembly of claim 1, wherein the flared end of the skateboard deck is fixed within the inner ring of the truck assembly.

8. The assembly of claim 1, wherein the flared end of the skateboard deck extends through the inner ring of the truck assembly.

9. A skateboard comprising:

a skateboard deck, wherein the skateboard deck includes a horizontal portion and a pair of flared ends;

a pair of truck assemblies comprising:

an inner ring adapted to be attachable to a skateboard deck; and an outer ring adapted to be attachable to an axle extending from the outer ring, wherein the axle is configured to receive at least one wheel, and wherein the inner ring and the outer ring rotate relative to one another upon a change in an orientation of the skateboard deck, and wherein the flared end of the skateboard deck is attached to the inner ring of the truck assembly in any suitable manner including a detachable configuration so that the truck assembly can be attached to any suitable skateboard deck; and a plurality of wheels attached to the axles extending from the outer ring.

10. The skateboard of claim 9, wherein the change in the orientation of the skateboard deck results in the inner ring rotating relative to the outer ring, which results in a turning response of the skateboard.

11. The skateboard of claim 9, wherein the inner ring has an inner groove on an outer portion of the inner ring.

12. The skateboard of claim 11, wherein the outer ring has an inner groove on an inner portion of the outer ring.

13. The skateboard of claim 12, further comprising a plurality of bearings within the inner groove of the inner ring and the inner groove of the outer ring.

14. The skateboard of claim 9, wherein the skateboard deck transitions from the horizontal portion to the pair of flared ends towards each end of the deck at a transition point having an angle of transition of between about 0 and 60 degrees.

15. The skateboard of claim 9, wherein the flared end of the skateboard deck is fixed within the inner ring of the truck assembly.

16. The skateboard of claim 9, wherein the flared end of the skateboard deck extends through the inner ring of the truck assembly.

* * * * *